US007562626B2

(12) United States Patent
Morizumi et al.

(10) Patent No.: US 7,562,626 B2
(45) Date of Patent: Jul. 21, 2009

(54) METHOD OF PRODUCING SCRATCH PRINTING PRODUCT BY USING SCRATCH LAYER TRANSFER SHEET

(75) Inventors: Daigo Morizumi, Tokyo-to (JP); Keiji Hirose, Tokyo-to (JP); Masafumi Hayashi, Tokyo-to (JP); Nobuho Ikeuchi, Tokyo-to (JP); Mikio Asajima, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 11/856,340

(22) Filed: Sep. 17, 2007

(65) Prior Publication Data

US 2008/0070780 A1 Mar. 20, 2008

Related U.S. Application Data

(60) Continuation of application No. 11/152,522, filed on Jun. 14, 2005, now abandoned, which is a division of application No. 09/901,736, filed on Jul. 10, 2001, now Pat. No. 6,939,627.

(30) Foreign Application Priority Data

| | | |
|---|---|---|
| Jul. 13, 2000 | (JP) | 2000-212248 |
| Jul. 26, 2000 | (JP) | 2000-224899 |
| Mar. 13, 2001 | (JP) | 2001-070268 |

(51) Int. Cl.
*B41M 5/40* (2006.01)
*B42D 15/10* (2006.01)

(52) U.S. Cl. ..... 101/491; 101/487; 428/32.76; 428/195.1; 400/120.01; 283/100; 283/903

(58) Field of Classification Search ..... 428/32.76; 101/491, 487
See application file for complete search history.

(56) References Cited

U.S. PATENT DOCUMENTS

| | | | | |
|---|---|---|---|---|
| 5,260,256 | A * | 11/1993 | Takahara et al. | 503/227 |
| 5,612,120 | A * | 3/1997 | Tago et al. | 428/32.83 |
| 6,194,348 | B1 * | 2/2001 | Onishi et al. | 503/227 |

FOREIGN PATENT DOCUMENTS

JP 11198554 A * 7/1999

OTHER PUBLICATIONS

Partial English language translation of Kawabata (JP 11-198554 A).*

* cited by examiner

*Primary Examiner*—Leslie J Evanisko
(74) *Attorney, Agent, or Firm*—Ladas & Parry LLP

(57) ABSTRACT

A scratch layer transfer sheet comprising a substrate film and a transferable scratch layer disposed on one surface of the substrate film, the transferable scratch layer comprising a hiding layer, being able to be thermally transferred to the print surface of a transfer-receiving material and being able to be removed from the print surface by scratching it after it is transferred. The scratch layer transfer sheet is overlapped on a transfer-receiving material such that the transferable scratch layer faces the print surface of the transfer-receiving material to transfer said transferable scratch layer to the print surface by heating.

23 Claims, 11 Drawing Sheets

FIG. 23

DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP
DNP DNP DNP DNP DNP DNP DNP DNP DNP DNP DNP DNP

FIG. 24

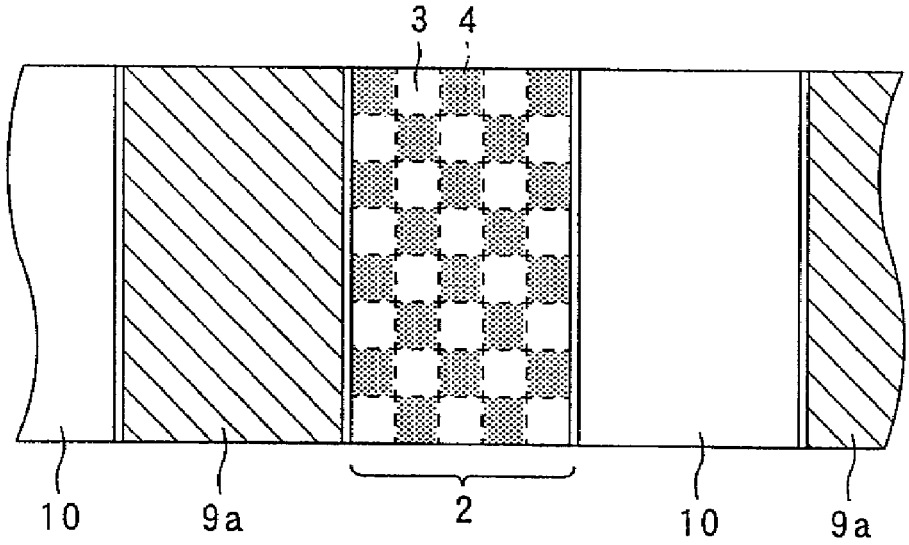

METHOD OF PRODUCING SCRATCH PRINTING PRODUCT BY USING SCRATCH LAYER TRANSFER SHEET

BACKGROUND OF THE INVENTION

1. Field of the Invention

The present invention relates to a thermal transfer sheet used for a thermal transfer printer performing transfer by heating using a thermal head or the like, and, particularly, to a scratch layer thermal transfer sheet which can hide information recorded on, particularly paper or a card such that the information is made indistinguishable easily as it is and besides, the hidden part can be easily scratched off by a nail or a coin, and further relates to a method using the scratch layer thermal transfer sheet and a transfer-receiving material to produce a scratch printing product.

2. Description of the Related Art

Print products with a hidden image disposed under a hiding ink layer, which image is allowed to emerge by scratching off the hiding ink layer using a nail or a coin to thereby scrape it, are currently used generally for lottery tickets, prepaid cards and the like. These print products respectively have a structure in which an image including characters and designs is printed on the surface of an opaque substrate such as a plastic film, paper or synthetic paper by using printing ink, solid printing is made on the entire surface by using opaque ink in such a manner as to cover the whole printed image and the surface of the image is hidden by a peelable ink layer.

Also, such a method is currently adopted in which using a thermal transfer sheet formed with a thermal transfer layer on a substrate, the thermal transfer sheet is heated imagewise from the backface thereof by using a thermal head to form an image constituted of variable information and, further, using a thermal transfer sheet provided with a thermal transfer layer capable of being a hiding layer, the thermal transfer layer is thermally transferred to the surface of the image, without forming a hiding ink layer by a printing method using a plate, to thereby hide the image.

However, even if a thermal transfer sheet provided with a thermal transfer layer having hiding ability is used with the intention to hide information recorded on a card or the like such that the information is made indistinguishable easily as it is by thermal transfer, there is the case where the following problem arises when the recorded information is accompanied by an irregularity (for example, in the case of recording information by thermal transfer, ink is stuck only to the transfer portion and only this portion therefore rises). Specifically, even if the hiding ink layer has a hiding capability enough to prevent the underlying display from being seen through, the surface resultantly follows the irregular pattern and a difference in surface glossiness with the result that the recorded information can be read.

Also, if a substrate as a medium on which information is recorded is a medium having a low surface smoothness, such as paper, there is the problem that the hiding layer cannot be easily scratched off on account of an anchor effect.

In addition, conventionally, a thermal transfer sheet provided with a hiding thermal transfer layer which can be scratched off and a thermal transfer sheet for information recording are separately prepared. First, thermal transfer recording is made on a transfer-receiving material by using the thermal transfer sheet for information recording. Next, the thermal transfer sheet is exchanged with the thermal transfer sheet provided with the hiding thermal transfer layer to hide the recorded part. This method poses the problem that two types of thermal transfer sheet are used for one print product and therefore troublesome works for exchanging these thermal transfer sheets and material cost are needed.

SUMMARY OF THE INVENTION

Accordingly, in order to solve the above problem, an object of the present invention is to provide a scratch layer transfer sheet which can hide information recorded on a card or the like such that the information is made indistinguishable easily as it is and besides, the hidden part can be easily scratched off by a nail or a coin and a method of producing a print product in which the display surface of the transfer-receiving material is coated with a scratch layer by using the scratch layer transfer sheet.

Another object of the present invention is to provide a scratch layer transfer sheet which is free from troublesome works for exchanging a thermal transfer sheet for recording information with the other one for coating the scratch layer and makes it possible to work simply and a method of producing a scratch print product by using the thermal transfer sheet.

A scratch layer transfer sheet according to the present invention comprises a substrate film and a transferable scratch layer formed on one surface of the substrate film, the transferable scratch layer comprising a hiding layer, being able to be thermally transferred to the print surface of a transfer-receiving material and being able to be removed from the print surface by scratching it after it is transferred.

The information to be hidden is printed in advance on the print surface of the transfer-receiving material and the transferable scratch layer of the scratch layer transfer sheet according to the present invention is overlapped on the print surface. Then, the scratch layer transfer sheet is heated by a heating means such as a thermal head to thereby thermally transfer the scratch layer to the print surface, whereby the information can be hidden.

The above hiding layer is preferably formed of a heat meltable ink comprising a hiding material and a binder. The heat meltable ink for the hiding layer preferably contains an aluminum pigment, carbon black, wax and an ethylene/vinyl acetate copolymer as essential components.

The above transferable scratch layer may be a multilayer structure. In this case, one or more layer including a pattern layer, a peeling layer and an adhesive layer may be combined with the hiding layer as occasion demand.

Preferably, the above transferable scratch layer further comprises a pattern layer formed pattern-wise and has a multilayer structure in which at least the pattern layer and the hiding layer are disposed in this order from the side close to the above substrate film. The pattern layer may be provided with patterns such as a firm name, logo and specific mark.

If a rise of a coloring agent takes place when information is recorded on the print surface of the transfer-receiving material, there is the case where the surface of the hiding layer follows the rise of the coloring agent or is changed in surface glossiness in accordance with the notation of the recorded information, resulting in the emergence of the pattern showing the notation content even if the print surface is coated with a non-transmittable hiding layer. Even in the case of such a print surface having a rise of a coloring agent, a coating of the scratch layer laminating the hiding layer and pattern layer makes it possible to obtain an excellent hiding effect due to the through-vision preventive action of the hiding layer and to the surface camouflage action of the pattern layer.

It is preferable that when the areas respectively occupied by the pattern layer and the hiding layer are compared with each other, the proportion of the area occupied by the pattern layer (pattern ratio) be in a range from 5 to 85% per 2 $cm^2$ of the transferred scratch layer.

The area of one partition of the transferable scratch layer of the above scratch layer transfer sheet is preferably in a range from 30 to 150% based on the maximum area of the print surface of the transfer-receiving material to which the transferable scratch layer is to be transferred.

The above transferable scratch layer after being transferred to the transfer-receiving material preferably has a level of HB or less as the pencil scratch value prescribed in the handwriting method of JIS K 5400.

In a preferable embodiment, the above scratch layer transfer sheet comprises a transferable protective layer having a monolayer or multilayer structure and provided with a main protective layer which protects the print surface in combination with the transferable scratch layer and the transferable protective layer and the above transferable scratch layer are alternately provided side by side on the above substrate film.

If the print surface of the transfer-receiving material is coated with a scratch layer through a protective layer, the irregularities of the part of the information recorded on the print surface are smoothed by the protective layer and the hiding ability is therefore improved. The protective layer also has the effect of preventing background soils on the print surface and the effect of preventing the occurrence of scratch inferiors caused by the penetration of the scratch layer into the surface of the transfer-receiving material.

Also, in the case where the protective layer and the scratch layer can be transferred to the print surface of the transfer-receiving material from the same thermal transfer sheet, the advantages that the facilities for producing a scratch print product can be scaled down and simplified are offered.

In another preferable embodiment, the above scratch layer transfer sheet comprises a coloring agent transfer layer together with the transferable scratch layer and the coloring agent transfer layer and the above transferable scratch layer are alternately provided side by side on the above substrate film.

Also, in the case where the recording of the information to be hidden on the print surface of the transfer-receiving material and the transfer of the scratch layer to the print surface can be made in order by using the same thermal transfer sheet, there are the advantages that the facilities for producing a scratch print product can be scaled down and simplified.

In a particularly preferable embodiment, the above scratch layer transfer sheet comprises a coloring agent transfer layer, a transferable protective layer and a transferable scratch layer which are alternately provided side by side on the substrate film. If the thermal transfer sheet is used, all of a step of recording the information to be hidden, a step of coating the recorded information with the protective layer and a step of hiding the surface of the protective layer by the scratch layer can be continuously carried out by a thermal transfer method.

A method of producing a scratch print product according to the present invention makes use of the scratch layer transfer sheet according to the present invention as aforementioned and comprises the following steps of:

Providing a transfer-receiving material provided with a print surface on which information is recorded in advance;

providing a scratch layer transfer sheet comprising a substrate film and a transferable scratch layer disposed on one surface of the substrate film, the transferable scratch layer comprising a hiding layer, being able to be thermally transferred to the print surface of the transfer-receiving material and being able to be removed from the print surface by scratching after it is transferred; and overlapping the transferable scratch layer of the above scratch layer transfer sheet on the print surface of the above transfer-receiving material such that the transferable scratch layer faces the print surface to transfer the above transferable scratch layer to the print surface by heating.

The above print surface on which information is recorded in advance preferably has a center plane average roughness SPa of 10 μm or less in the measurement of three-dimensional roughness.

By designing the center plane average roughness SPa of the information record section to be 10 μm or less, the surface irregularities of the information record section to be hidden are decreased to secure the hiding by the scratch layer to be transferred from the thermal transfer sheet and it is possible to prevent the information record section from being read.

In a preferable embodiment, the above method of producing a scratch print product comprises providing an information recording thermal transfer sheet provided with a coloring agent transfer layer on one surface of the substrate film in addition to the above scratch layer transfer sheet;

preparing the above transfer-receiving material in which information is recorded in advance by overlapping the coloring agent transfer layer of the information recording thermal transfer sheet on a print surface of a transfer-receiving material in which no information is recorded such that the coloring agent transfer layer faces the print surface and by transferring the coloring agent to the print surface by heating to record the information; and thereafter transferring the transferable scratch layer of the above scratch layer transfer sheet to the print surface.

Information is recorded on the print surface of the transfer-receiving material by printing using plate or an on-demand system such as a thermal transfer method in advance before the print surface is coated with the scratch layer. The on-demand system is convenient in the point that variable information can be recorded. Among methods using the on-demand system, the case of using a thermal transfer sheet (coloring agent transfer sheet) which can transfer a coloring agent by a thermal transfer method such as heat melt transfer and sublimation thermal transfer has the advantage that facilities used to produce scratch print products can be scaled down and simplified because both of the recording of the information to be hidden and the coating of the print surface with the scratch layer can be carried out in the thermal transfer step.

Particularly in the case of continuously performing the step of recording the information to be hidden on the print surface of the transfer-receiving material and the step of coating the print surface with the scratch layer, it is convenient to use the thermal transfer sheet provided with the coloring agent transfer layer and the transferable scratch layer alternately side by side.

The above coloring agent transfer layer may be made to contain an optically distinguishable coloring agent, whereby information which can be seen under only invisible light is recorded as the information to be hidden.

The above coloring agent transfer layer may be a heat meltable ink layer. Particularly heat melting thermal transfer among the thermal transfer methods is an on-demand system and can record variable information on an individual print surface, but on the other hand, a rise of the heat meltable ink takes place on the print surface, making it difficult to hide the recorded information. On the contrary, the use of the scratch layer transfer sheet of the present invention ensures that the information printed by the heat melting thermal transfer can be hidden sufficiently. Therefore, the scratch layer transfer sheet of the present invention is preferably used to coat the print surface in which information is recorded by heat melting thermal transfer.

In a further preferable embodiment, the above method of producing a scratch print product comprises providing a protective layer transfer sheet comprising a transferable protective layer having a monolayer or multilayer structure and provided with a main protective layer protecting the print surface on one surface of the substrate film in addition to the above scratch layer transfer sheet;

overlapping the transferable protective layer of the protective layer transfer sheet on the print surface of the above transfer-receiving material such that the transferable protective layer faces the print surface to transfer the above transferable protective layer to the print surface by heating; and thereafter transferring the transferable scratch layer of the above scratch layer transfer sheet to the print surface.

As mentioned above, preferably a protective layer is formed on the print surface of the transfer-receiving material on which the information is recorded in advance and the scratch layer is thermally transferred using the scratch layer transfer sheet according to the present invention to the protective layer. The protective layer may be formed by coating the print surface of the transfer-receiving material with a protective layer coating solution. However, in the above method, the protective layer is transferred to the print surface of the transfer-receiving material from the protective layer transfer sheet, whereby both of the coating of the print surface with the protective layer and the coating of the print surface with the scratch layer can be carried out in the thermal transfer step, bringing about the advantage that facilities used to produce scratch print products can be scaled down and simplified.

Particularly, in the case of continuously performing the step of coating the print surface of the transfer-receiving material with the protective layer and the step of forming the scratch layer on the print surface through the protective layer, it is convenient to use the thermal transfer sheet in which the transferable protective layer and the transferable scratch layer are alternately provided side by side.

BRIEF DESCRIPTION OF THE DRAWINGS

FIG. 23 is a view showing a logo pattern as an example of a pattern of a pattern layer.

FIG. 24 is a plan view showing an example in which a heat meltable ink layer, a protective layer and a scratch layer are alternately provided side by side on the same substrate of a scratch layer transfer sheet according to the present invention.

DETAILED DESCRIPTION OF THE PREFERRED EMBODIMENTS

Figure 1:
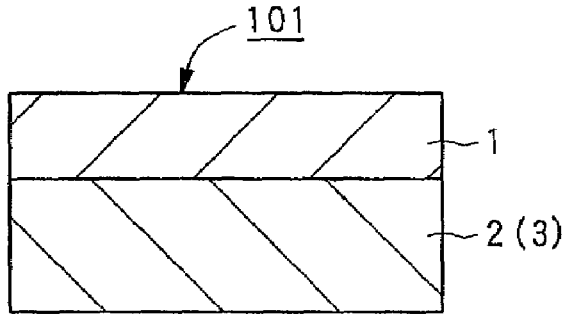
FIG. 1 is a sectional view showing one embodiment of a scratch layer transfer sheet according to the present invention.

A thermal transfer sheet, namely a scratch layer transfer sheet, provided by the present invention is constituted of at least a transferable scratch layer on one surface of a substrate film. Information to be hidden is printed in advance on the print surface of a transfer-receiving material. The transferable scratch layer of the scratch layer transfer sheet according to the invention is overlapped on the printed information with the both facing each other. The scratch layer transfer sheet is heated using heating means such as a thermal head to thereby thermally transfer the scratch layer to the print surface, thereby hiding the information.

The transferable scratch layer comprises a non-transmissible hiding layer which makes it difficult and desirably impossible to see through a notation given to the print surface when the print surface is coated.

The transferable scratch layer preferably has a multilayer structure in which the hiding layer and a pattern layer having a prescribed pattern are laminated on each other. When the hiding layer is combined with the pattern layer, the pattern layer and the hiding layer are generally laminated on the substrate film of the scratch layer transfer sheet in this order from the side close to the substrate film to form a transferable scratch layer. This transferable scratch layer eventually has a layer structure in which the pattern layer is disposed on the hiding layer after it is thermally transferred to the print surface of the transfer-receiving material.

If a rise of a coloring agent occurs when information is recorded on the print surface of the transfer-receiving material, the surface of the hiding layer follows the rise of the coloring agent and surface glossiness of the coloring agent even if the print surface is coated with a non-transmissible hiding layer. There is therefore the case where the surface of the hiding layer rises or is changed in surface glossiness in accordance with the notation of the recorded information, with the result that the configuration of the notation emerges. Even in the case of such a print surface having a rise of a coloring agent, the coating with the scratch layer in which the hiding layer and the pattern layer are laminated makes it possible to obtain an excellent hiding effect due to the through-vision preventive action of the hiding layer and to the surface camouflage action of the pattern layer.

A non-transferable matt layer may be disposed on the substrate film of the scratch layer transfer sheet and the transferable scratch layer may be disposed on the matt layer. When the scratch layer is thermally transferred to the print surface of the transfer-receiving material from this scratch layer transfer sheet, the print surface of the transfer-receiving material is coated with the scratch layer having a matt surface and therefore an excellent hiding effect is obtained due to the through-vision preventive action of the hiding layer disposed in the scratch layer and to the surface camouflage action of the matt surface of the scratch layer.

The transferable scratch layer may comprise a peeling layer. The provision of the transferable scratch layer on the substrate film of the scratch layer transfer sheet through the peeling layer can improve the transferability of the scratch layer. Also, the provision of the peeling layer between the hiding layer and pattern layer of the transferable scratch layer can make it more difficult to see through the information when the transferable scratch layer is transferred to the print surface.

An adhesive layer may be disposed on the surface of the transferable scratch layer. The provision of the adhesive layer on the surface of the transferable scratch layer can improve the scratch layer in thermal transfer ability, adhesion to the transfer-receiving material and scratch-off aptitude.

Information is recorded on the print surface of the transfer-receiving material by a printing method using a plate or an on-demand system printing method such as a thermal transfer method in advance before the print surface is coated with the scratch layer. The information to be hidden may be either visible information or information which can be seen under only invisible light. The on-demand system is convenient in the point that variable information can be recorded. Among methods using the on-demand system, the case of using a thermal transfer sheet (coloring agent transfer sheet) which can transfer a coloring agent by a thermal transfer method such as heat melting thermal transfer and sublimation thermal transfer has the advantage that facilities used to produce scratch print products can be scaled down and simplified because both of the recording of the information to be hidden and the coating of the print surface with the scratch layer can be carried out in the thermal transfer step. Particularly the heat melting thermal transfer among the thermal transfer methods is the on-demand system and can record variable information on an individual print surface, but on the other hand, a rise of the heat meltable ink takes place on the print surface, making it difficult to hide the recorded information. On the contrary, the use of the scratch layer transfer sheet of the present invention ensures that the information printed by the heat melting thermal transfer can be hidden sufficiently. Therefore, the scratch layer transfer sheet of the present invention is preferably used to coat the print surface on which information is recorded by heat melting thermal transfer.

For the purpose of improving the ability to transfer to the transfer-receiving material, the heat meltable ink layer of the heat melt type transfer sheet may be disposed on the substrate film through the peeling layer, or a adhesive layer may be disposed on the outermost surface side of the heat meltable ink layer.

It is preferable that a protective layer be formed on the print surface of the transfer-receiving material on which the information is recorded in advance and the scratch layer be thermally transferred on the protective layer by using the scratch layer transfer sheet according to the present invention. If the scratch layer is applied to the print surface of the transfer-receiving material through the protective layer, the irregularities of the part of the information recorded on the print surface are smoothed by the protective layer and the hiding ability is therefore improved. Also, the protective layer has the effect of preventing the background soiling of the print surface and also the development of scratch inferiors caused by the penetration of the scratch layer into the surface of the transfer-receiving material.

The protective layer may be thermally transferred to the print surface of the transfer-receiving material from a protective layer transfer sheet in which a transferable protective layer is disposed on the substrate film. In the case where the protective layer is thermally transferred to the print surface of the transfer-receiving material from the protective layer transfer sheet, both the coating of the print surface with the protective layer and the coating of the print surface with the scratch layer can be carried out in the thermal transfer step, bringing about the advantages that facilities for the production of scratch print products can be scaled down and simplified.

For the purpose of improving the ability to transfer to the transfer-receiving material, the transferable protective layer of the protective layer transfer sheet may be disposed on the substrate film through the peeling layer, or a adhesive layer may be disposed on the outermost surface side of the transferable protective layer.

Also, in the case where a step of recording the information to be hidden on the print surface of the transfer-receiving material, a step of coating the print surface with the protective layer and a step of forming the scratch layer on the print surface through the protective layer are all carried out, all of the above steps are preferably carried out by a thermal transfer method using the coloring agent transfer sheet, the protective layer transfer sheet and the scratch layer transfer sheet from the same reason that is mentioned above.

In the case where either one or both of a step of recording the information to be hidden on the print surface of the transfer-receiving material and a step of coating the print surface with the protective layer and a step of forming the scratch layer on the print surface through the protective layer are successively carried out, it is preferable to use a thermal transfer sheet obtained by integrating either one or both of the coloring agent transfer sheet and the protective layer transfer sheet with the scratch layer transfer sheet.

Specifically, the coloring agent transfer layer and the transferable scratch layer are alternately provided side by side on the substrate film of the scratch layer transfer sheet to thereby obtain a thermal transfer sheet in which the coloring agent transfer sheet is integrated with the scratch layer transfer sheet. Also, the transferable protective layer and the transferable scratch layer are alternately provided side by side on the substrate film of the scratch layer transfer sheet to thereby obtain a thermal transfer sheet in which the protective layer transfer sheet is integrated with the scratch layer transfer sheet. Further, the coloring agent transfer layer, the transferable protective layer and the transferable scratch layer are alternately provided side by side on the substrate film of the scratch layer transfer sheet to thereby obtain a thermal transfer sheet in which the coloring agent transfer sheet, the protective layer transfer sheet and the scratch layer transfer sheet are integrated with each other.

When, among these integral thermal transfer sheets, a thermal transfer sheet provided with the coloring agent transfer layer, the transferable protective layer and the transferable scratch layer is used, first the coloring agent transfer layer of the thermal transfer sheet is overlapped on the print surface of the transfer-receiving material with the both facing each other, followed by heating to record the information to be hidden. Then, the coloring agent transfer layer is separated. Next, the transferable protective layer of the thermal transfer sheet is overlapped on the same print surface with the both facing each other, followed by heating to transfer the protective layer to the print surface thereby coating the print surface with the protective layer. Then, the transferable scratch layer of the thermal transfer sheet is overlapped on the same print surface with the both facing each other, followed by heating to transfer the scratch layer to the protective layer thereby coating the protective layer with the scratch layer. Thus a scratch print product is obtained.

The present invention will be hereinafter explained by way of preferable embodiments. In these embodiments, parts common to different embodiments are designated by the same symbols.

FIG. 1 is a schematical view showing the section of one embodiment (101) of a thermal transfer sheet according to the present invention. In the thermal transfer sheet 101, a transferable scratch layer 2 is disposed on one surface of a substrate film 1. The transferable scratch layer 2 of the thermal transfer sheet 101 is constituted only of a hiding layer 3 containing a hiding material and a binder as essential components. When the transferable scratch layer 2 of the thermal transfer sheet 101 is thermally transferred to a transfer-receiving material, the transferable scratch layer 2 is stuck and applied to the surface of the transfer-receiving material. This transferable scratch layer 2 can be scraped off and removed from the transfer-receiving material by scratching.

Figure 2:
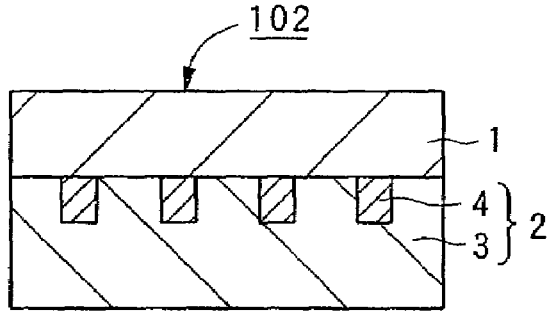
FIG. 2 is a sectional view showing another embodiment of a scratch layer transfer sheet according to the present invention.

FIG. 2 is a schematical view showing the section of another embodiment 102 of a thermal transfer sheet according to the present invention. In the thermal transfer sheet 102, a transferable scratch layer 2 is disposed on one surface of a substrate film 1. The transferable scratch layer 2 of the thermal transfer sheet 102 has a multilayer structure in which a pattern layer 4 provided pattern-wise and a hiding layer 3 are disposed in this order from the side close to the substrate film.

Figure 3:
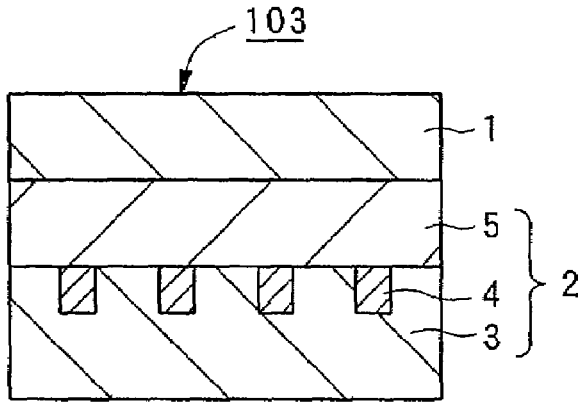
FIG. 3 is a sectional view showing another embodiment of a scratch layer transfer sheet according to the present invention.

FIG. 3 is a schematical view showing the section of another embodiment (103) of a thermal transfer sheet according to the present invention. In the thermal transfer sheet 103, a transferable scratch layer 2 is disposed on one surface of a substrate film 1. The transferable scratch layer 2 of the thermal transfer sheet 103 has a multilayer structure in which a peeling layer 5, a pattern layer 4 provided pattern-wise and a hiding layer 3 are disposed in this order from the side close to the substrate film.

Figure 4:
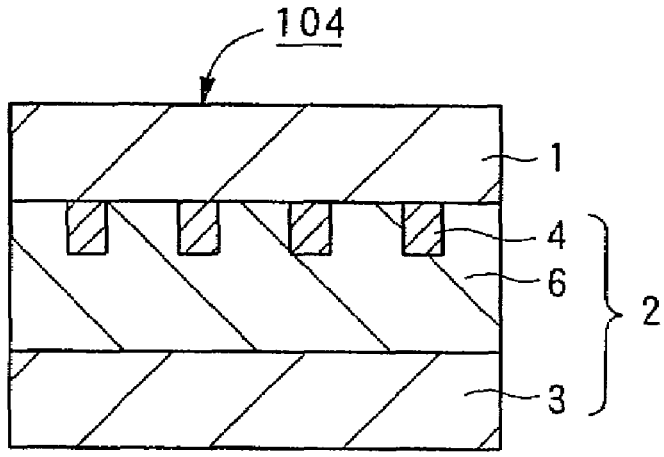
FIG. 4 is a sectional view showing another embodiment of a scratch layer transfer sheet according to the present invention.

FIG. 4 is a schematical view showing the section of another embodiment (104) of a thermal transfer sheet according to the present invention. In the thermal transfer sheet 104, a transferable scratch layer 2 is disposed on one surface of a substrate film 1. The transferable scratch layer 2 of the thermal transfer sheet 104 has a multilayer structure in which a pattern layer 4 provided pattern-wise, a peeling layer 6 and a hiding layer 3 are disposed in this order from the side close to the substrate film.

Figure 5:
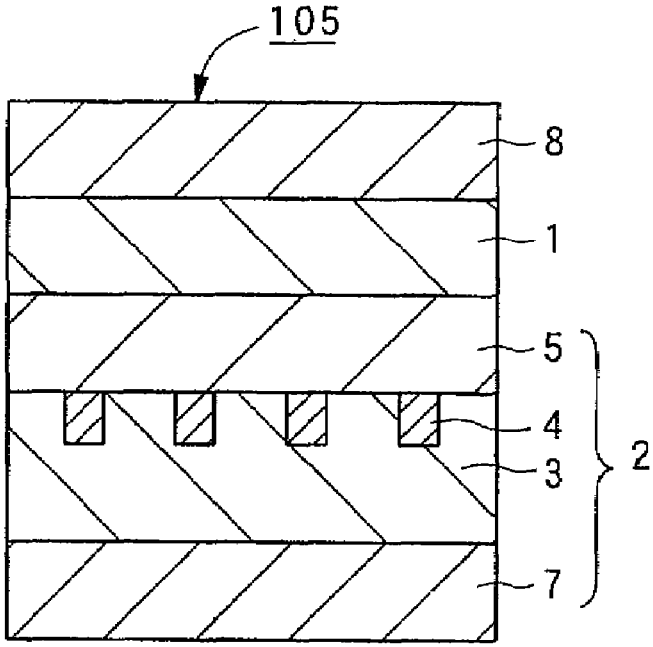
FIG. 5 is a sectional view showing another embodiment of a scratch layer transfer sheet according to the present invention.

FIG. 5 is a schematical view showing the section of another embodiment (105) of a thermal transfer sheet according to the present invention. In the thermal transfer sheet 105, a transferable scratch layer 2 is disposed on one surface of a substrate film 1. The transferable scratch layer 2 of the thermal transfer sheet 105 has a multilayer structure in which a peeling layer 5, a pattern layer 4 provided pattern-wise, a hiding layer 3 and an adhesive layer 7 are disposed in this order from the side close to the substrate film. On the other hand, a heat resistant layer 8 is disposed on the other surface of the substrate film 1. This thermal transfer sheet 105 may be controlled by the adhesive layer 7 as to the transfer ability and scratch-off aptitude of the transferable scratch layer 2 transferred to the transfer-receiving material. Also, adverse effects such as sticking during heating by a thermal head and printing wrinkles can be prevented by the heat resistant layer 8.

Figure 6:
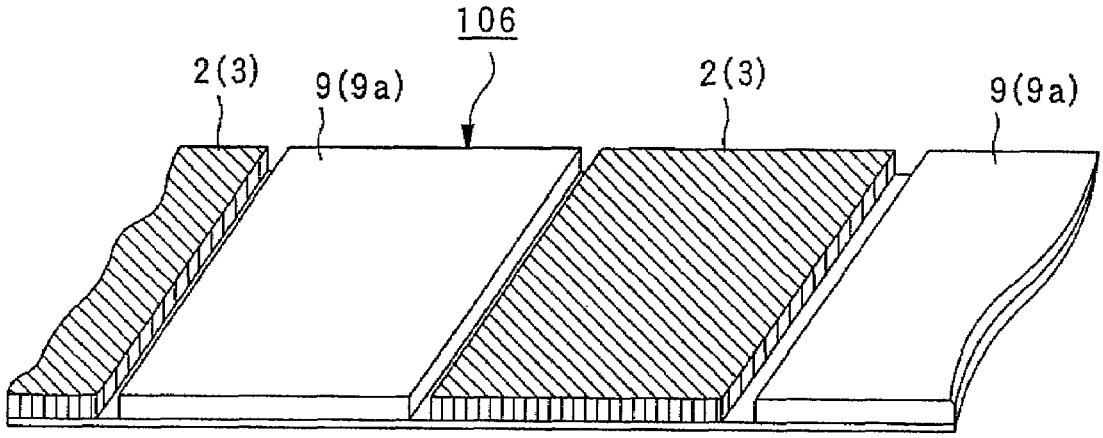
FIG. 6 is a perspective view showing another embodiment of a scratch layer transfer sheet according to the present invention.

FIG. 6 is a perspective view schematically showing another embodiment (106) of a thermal transfer sheet according to the present invention. In the thermal transfer sheet 106, a heat meltable ink layer 9*a* as a coloring agent transfer layer 9 which can arbitrarily record characters and information and a transferable scratch layer 2 having a monolayer structure constituted only of a hiding layer 3 are alternately applied separately side by side repeatedly on one surface of a substrate film 1.

Figure 7:
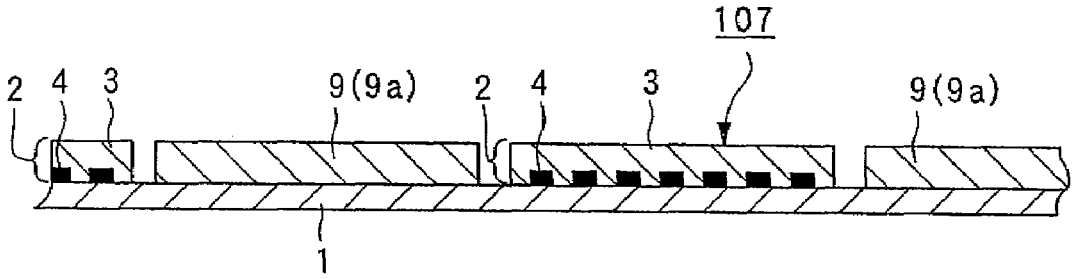
FIG. 7 is a sectional view showing another embodiment of a scratch layer transfer sheet according to the present invention.

FIG. 7 is a schematical view showing the section of another embodiment (107) of a thermal transfer sheet according to the present invention. In the thermal transfer sheet 107, a heat meltable ink layer 9*a* as a coloring agent transfer layer 9 which can arbitrarily record characters and information and a transferable scratch layer 2 are alternately applied separately side by side repeatedly on one surface of a substrate film 1. The transferable scratch layer 2 of the thermal transfer sheet 107 has a multilayer structure in which a pattern layer 4 provided pattern-wise and a hiding layer 3 are disposed in this order from the side close to the substrate film.

Figure 8:
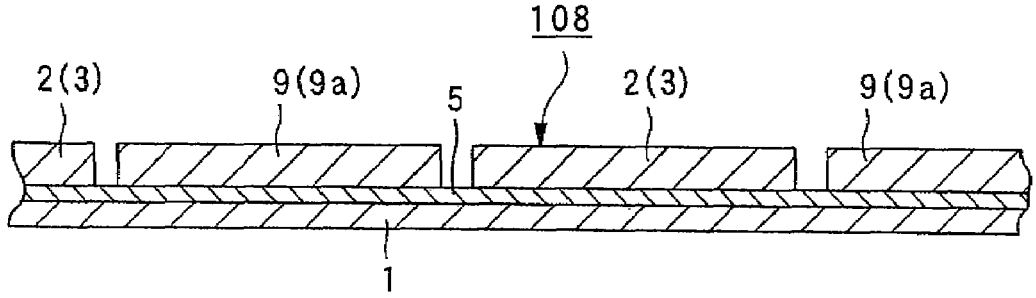
FIG. 8 is a sectional view showing another embodiment of a scratch layer transfer sheet according to the present invention.

FIG. 8 is a schematical view showing the section of another embodiment (108) of a thermal transfer sheet according to the present invention. In the thermal transfer sheet 108, a peeling layer 5 is disposed on the entire of one surface of a substrate film 1. On the peeling layer, a heat meltable ink layer 9*a* as a coloring agent transfer layer 9 which can arbitrarily record characters and information and a transferable scratch layer 2 are alternately applied separately side by side repeatedly. The transferable scratch layer 2 of the thermal transfer sheet 108 has a monolayer structure is constituted only of a hiding layer 3. However, the transferable scratch layer 2 of the thermal transfer sheet 108 may have a multilayer structure in which a pattern layer provided pattern-wise and a hiding layer are disposed on the peeling layer 5 in this order from the side close to the substrate film.

Figure 9:
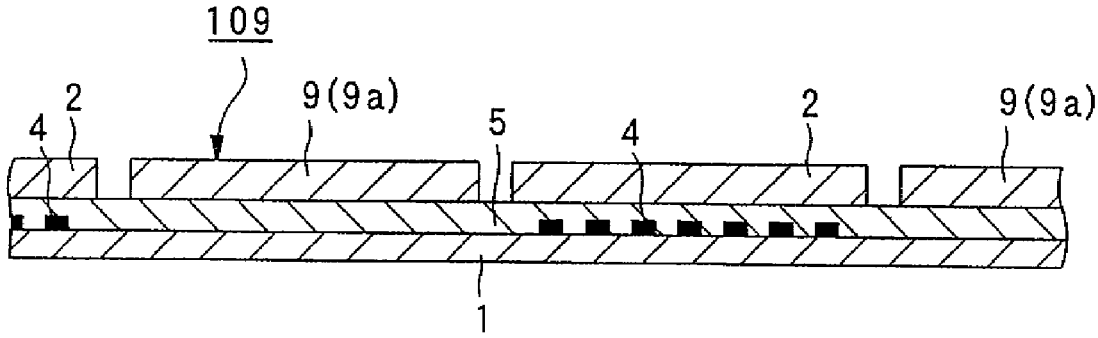
FIG. 9 is a sectional view showing another embodiment of a scratch layer transfer sheet according to the present invention.

FIG. 9 is a view showing the section of another embodiment (109) of a thermal transfer sheet according to the present invention. In the thermal transfer sheet 109, a pattern layer 4 is partly provided on one surface of a substrate film 1, a peeling layer 5 is disposed on the entire surface of the pattern layer 4 and substrate film 1. On the peeling layer 5, a heat meltable ink layer 9*a* as a coloring agent transfer layer 9 and a transferable scratch layer 2 are alternately applied separately side by side repeatedly. It is to be noted that the separate application is made such that the pattern layer 4 exists under the transferable scratch layer 2 and no pattern layer exists under the heat meltable ink layer 9*a*.

Figure 10:
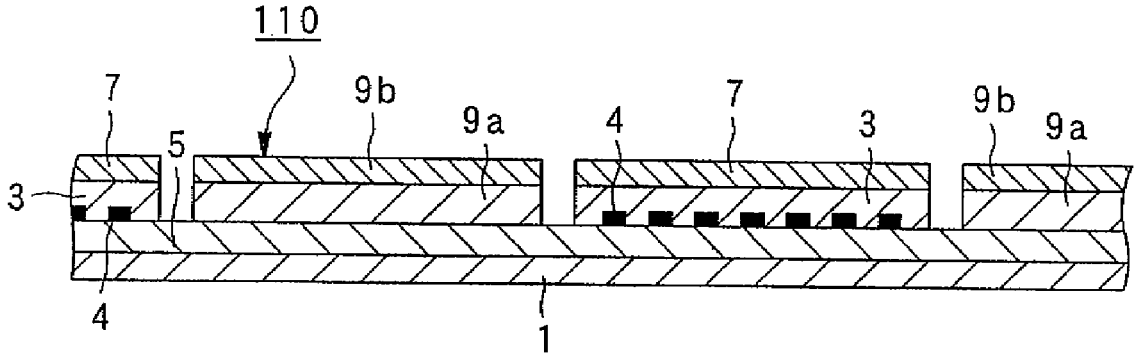
FIG. 10 is a sectional view showing another embodiment of a scratch layer transfer sheet according to the present invention.

FIG. 10 is a view showing the section of another embodiment (110) of a thermal transfer sheet according to the present invention. In the thermal transfer sheet 110, a peeling layer 5 is disposed on the entire of one surface of a substrate film 1 and on the peeling layer 5, a coloring agent transfer layer 9 in which a heat meltable ink layer 9*a* and an adhesive layer 9*b* are laminated and a transferable scratch layer 2 in which a pattern layer 4, a hiding layer 3 and an adhesive layer 7 are laminated are alternately applied separately side by side repeatedly.

Figure 11:
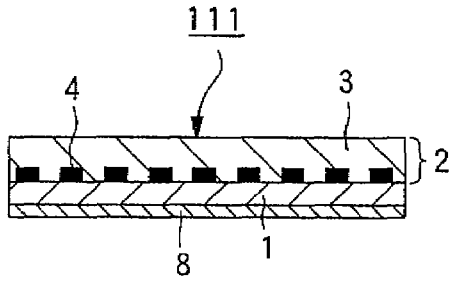
FIG. 11 is a sectional view showing another embodiment of a scratch layer transfer sheet according to the present invention.

FIG. 11 is a view showing the section of another embodiment (111) of a thermal transfer sheet 1 according to the present invention. In the thermal transfer sheet 111, a pattern layer 4 provided pattern-wise and a hiding layer 3 containing a hiding material and a binder are disposed on a substrate film 1 in this order from the side close to the substrate film. In this case, a combination of the pattern layer 4 and the hiding layer 3 constitutes a transferable scratch layer 2. In this thermal transfer sheet 111, the information recorded on the transfer-receiving material can be hidden by transferring the transferable scratch layer 2 to a transfer-receiving material. Also, the scratch layer can be removed from the transfer-receiving material by scratching the scratch layer. Further, a heat resistant layer 8 is disposed on the backface of the substrate film 1 to prevent adverse effects such as sticking caused by the heat of a thermal head and printing wrinkles.

Figure 12:
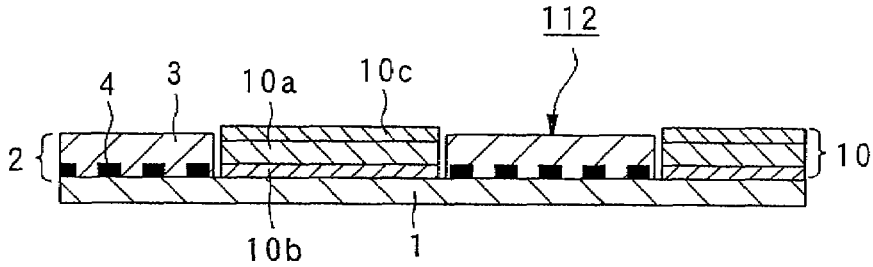
FIG. 12 is a sectional view showing another embodiment of a scratch layer transfer sheet according to the present invention.

FIG. 12 is a view showing the section of another embodiment (112) of a thermal transfer sheet according to the present invention. In the thermal transfer sheet 112, a transferable scratch layer 2 and a transferable protective layer 10 are alternately provided repeatedly side by side on one surface of a substrate film 1. The transferable scratch layer 2 has a structure in which a pattern layer 4 and a hiding layer 3 are laminated in order from the side close to the substrate film 1. The transferable protective layer 10 has a structure in which a peeling layer 10*b*, a main protective layer 10*a* and an adhesive layer 10*c* are laminated in this order from the side close to the substrate film 1.

Figure 13:
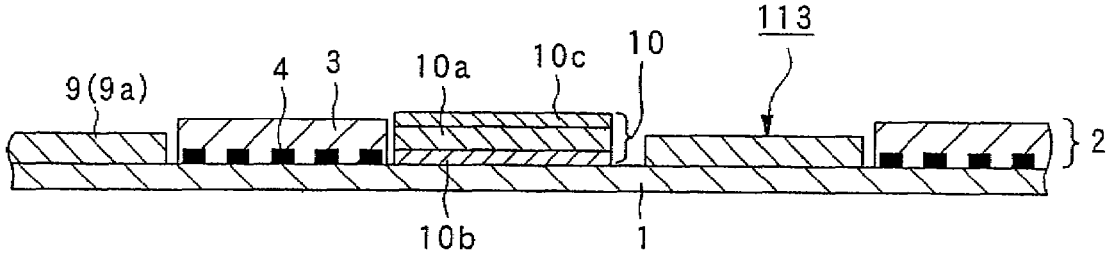
FIG. 13 is a sectional view showing another embodiment of a scratch layer transfer sheet according to the present invention.

FIG. 13 is a view showing the section of another embodiment (113) of a thermal transfer sheet according to the present invention. In the thermal transfer sheet 113, a heat meltable ink layer 9*a* as a coloring agent transfer layer 9, a transferable scratch layer 2 and a transferable protective layer 10 are alternately provided side by side on one surface of a substrate film 1. The transferable scratch layer 2 has a structure in which a pattern layer 4 and a hiding layer 3 are laminated in order from the side close to the substrate film 1. The transferable protective layer 10 has a structure in which a peeling layer 10*b*, a main protective layer 10*a* and an adhesive layer 10*c* are laminated in this order from the side close to the substrate film 1.

Figure 14:
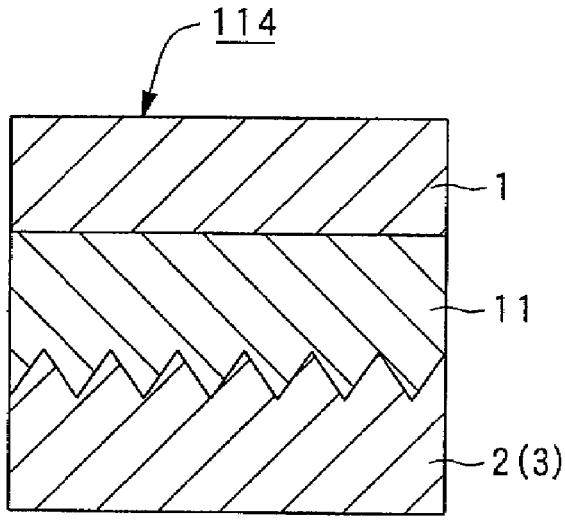
FIG. 14 is a sectional view showing another embodiment of a scratch layer transfer sheet according to the present invention.

FIG. 14 is a view showing the section of another embodiment (114) of a thermal transfer sheet according to the present invention. In the thermal transfer sheet 114, a non-transferable matt layer 11 is formed on the entire of one surface of a substrate film 1 and a transferable scratch layer 2 having a monolayer structure consisting only of a hiding layer 3 is disposed through the matt layer.

Figure 15:
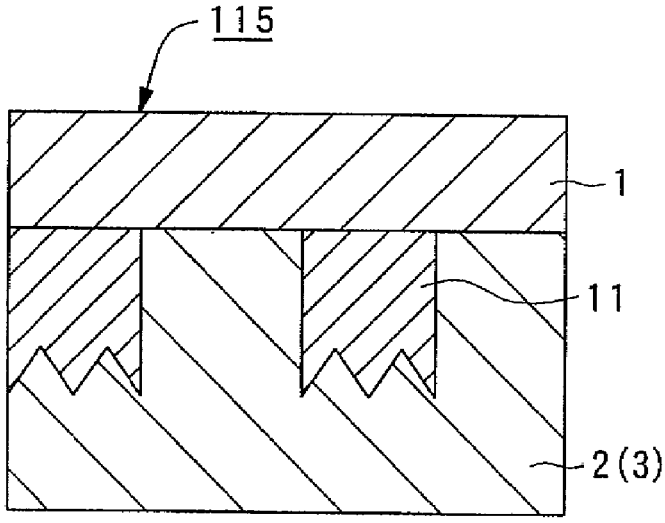
FIG. 15 is a sectional view showing another embodiment of a scratch layer transfer sheet according to the present invention.

FIG. 15 is a view showing the section of another embodiment (115) of a thermal transfer sheet according to the present invention. In the thermal transfer sheet 115, a non-transferable matt layer 11 is formed in a predetermined pattern form and further a transferable scratch layer 2 having a monolayer structure consisting only of a hiding layer 3 is disposed on the matt layer and the substrate film.

In all of the aforementioned FIG. 1 to FIG. 15, a heat resistant layer may be disposed on the surface of the substrate film on the side opposite to the surface on which the transferable scratch layer is disposed. This prevents adverse effects such as sticking caused by the heat of a thermal head and printing wrinkles.

Also, the scratch layer transfer sheet is not limited to those shown in the drawings and may be selected from various modifications within the scope of the Claims of the patent of this invention.

In the present invention, the transferable scratch layer 2 is transferred to the transfer-receiving material to become a scratch layer 2' and to form a hiding part 14. The scratch layer 2' after the transferable scratch layer 2 is transferred is provided with at least a hiding layer 3' and, as required, provided with a pattern layer 4', peeling layers 5' and 6' and an adhesive layer 7' occasionally. Therefore, the transferred scratch layer 2' has the same structure as the transferable scratch layer 2. However, the vertical position of each layer is inverted as a result of the transfer to the transfer-receiving material. Also, there is the case where the transferable protective layer 10 is transferred to the transfer-receiving material, resulting in the formation of a protective layer 10' in the hiding part 14. In this case, the scratch layer 2' is laminated on the print surface of the transfer-receiving material through the protective layer 10'.

Figure 16:
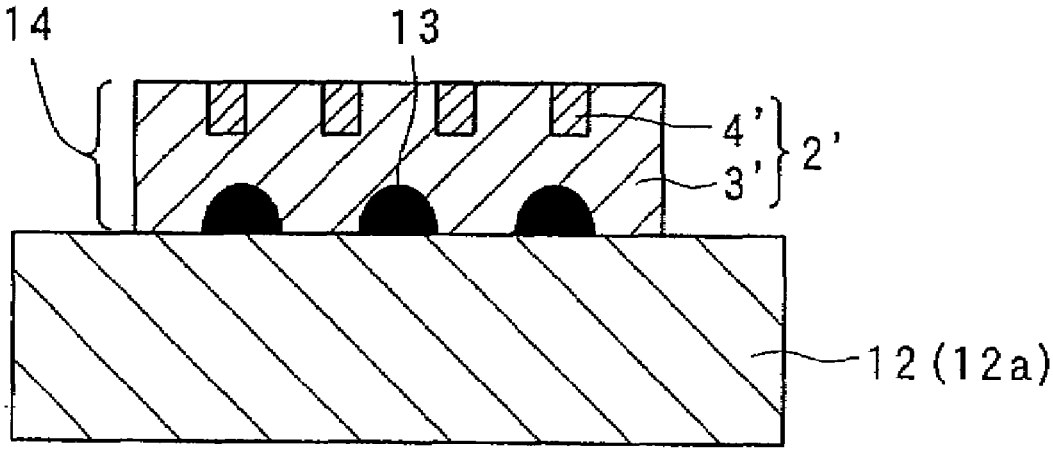
FIG. 16 is a sectional view showing one embodiment showing a condition after a hiding part is thermally transferred to the information recorded in advance on a transfer-receiving material by using a scratch layer transfer sheet according to the present invention.

FIG. 16 is a schematical sectional view showing the condition after the hiding part 14 is thermally transferred to a card 12*a* as the transfer-receiving material 12, on which card an information 13 is recorded in advance, by using the above thermal transfer sheet 102. The information 13 is recorded in the raised state on the surface of the leveled surface of the card. The scratch layer 2 is transferred to the print surface including the raised part and the unrecorded part (which means the remainder part of the print surface excluding the part of the recorded information 13, the same as follows) to hide the recorded information 13. Also, the scratch layer 2' has a layer structure in which the pattern layer 4' provided pattern-wise is disposed on the hiding layer 3'. On viewing the hiding part 14 of the transfer-receiving material 12 from the above, the glossiness and color including tone and chroma of the surface vary because two layers consisting of the hiding layer 3' and the pattern layer 4' are intermingled, making it possible to prevent the recorded information 13 from being read on account of the rise of the information section.

Figure 17:
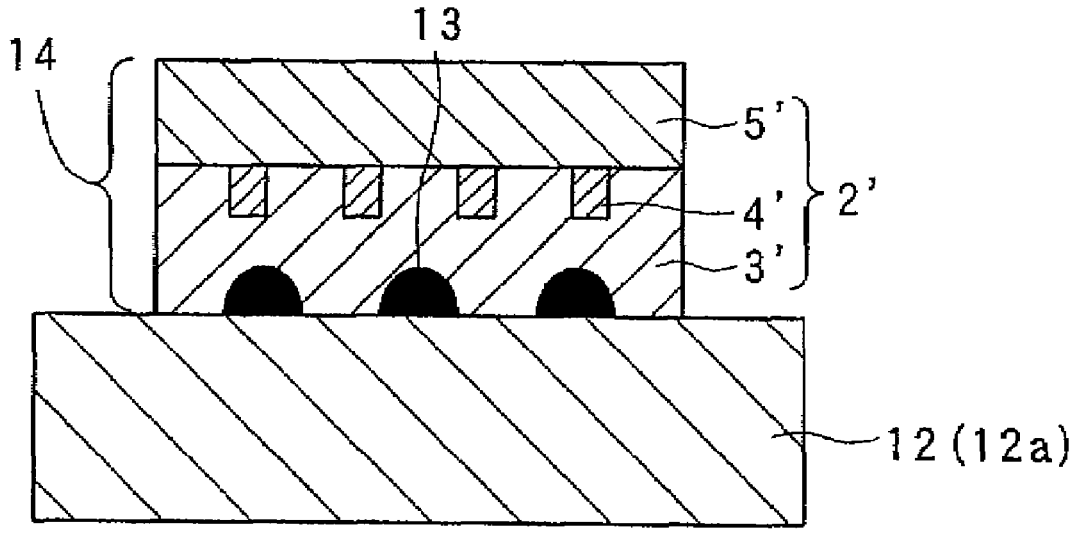
FIG. 17 is a sectional view showing another embodiment showing a condition after a hiding part is thermally transferred to the information recorded in advance on a transfer-receiving material by using a scratch layer transfer sheet according to the present invention.

FIG. 17 is a schematical sectional view showing the condition after the hiding part 14 is thermally transferred to a card 12*a* as the transfer-receiving material 12, on which card an information 13 is recorded in advance, by using the above thermal transfer sheet 103. The information 13 is recorded in the raised state on the surface of the leveled surface of the card. The scratch layer 2 is transferred to the print surface including the raised part and the unrecorded part to hide the recorded information 13. Also, the scratch layer 2' has a layer structure in which the pattern layer 4' provided pattern-wise is disposed on the hiding layer 3'. On viewing the hiding part 14 of the transfer-receiving material 12 from the above, the glossiness and color including tone and chroma of the surface vary because two layers consisting of the hiding layer 3' and the pattern layer 4' are intermingled, making it possible to prevent the recorded information 13 from being read on account of the rise of the information part. Also, transferable scratch layer is peeled off smoothly from the substrate film 1 thanks to the peeling layer and thermally transferred to the print surface of the transfer-receiving material, with the result that the transferred scratch layer has a layer structure in which the pattern layer 4' provided pattern-wise is disposed on the transferred hiding layer 3' and further the peeling layer 5' is disposed on the entire surfaces of the pattern layer 4' and hiding layer 3'.

Figure 18:
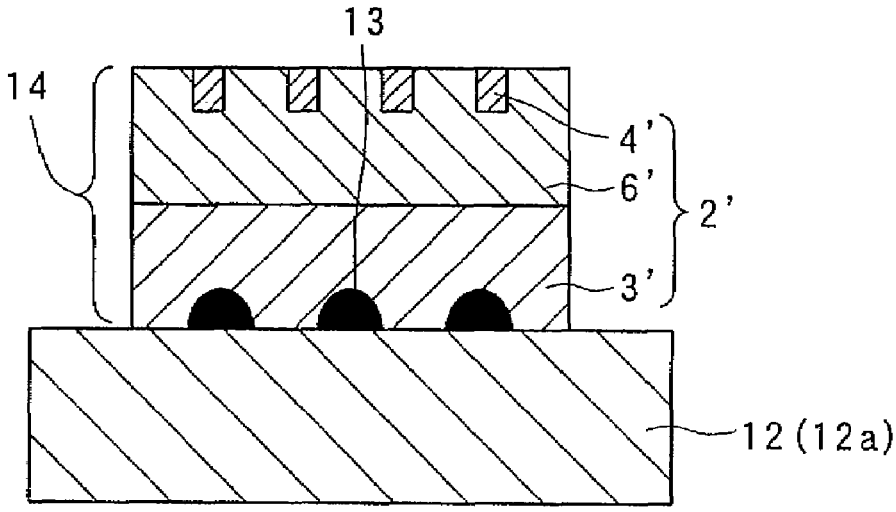
FIG. 18 is a sectional view showing another embodiment showing a condition after a hiding part is thermally transferred to the information recorded in advance on a transfer-receiving material by using a scratch layer transfer sheet according to the present invention.

FIG. 18 is a schematical sectional view showing the condition after the hiding part 14 is thermally transferred to a card 12*a* as the transfer-receiving material 12 on which card an information 13 is recorded in advance by using the above thermal transfer sheet 104 of the present invention. The information 13 is recorded in the raised state on the surface of the leveled surface of the card. The scratch layer 2 is transferred to the print surface including the raised part and the unrecorded part to hide the recorded information 13. Also, the transferred scratch layer 2' has a layer structure in which a peeling layer 6' is disposed on the hiding layer 3' and the pattern layer 4' having a predetermined pattern is disposed on the peeling layer 6'. On viewing the hiding part 14 of the transfer-receiving material 12 from the above, the glossiness and color including tone and chroma of the surface vary because two layers consisting of the hiding layer 3' and the pattern layer 4' are intermingled, making it possible to prevent the recorded information 13 from being read on account of the rise of the information section.

Figure 19:
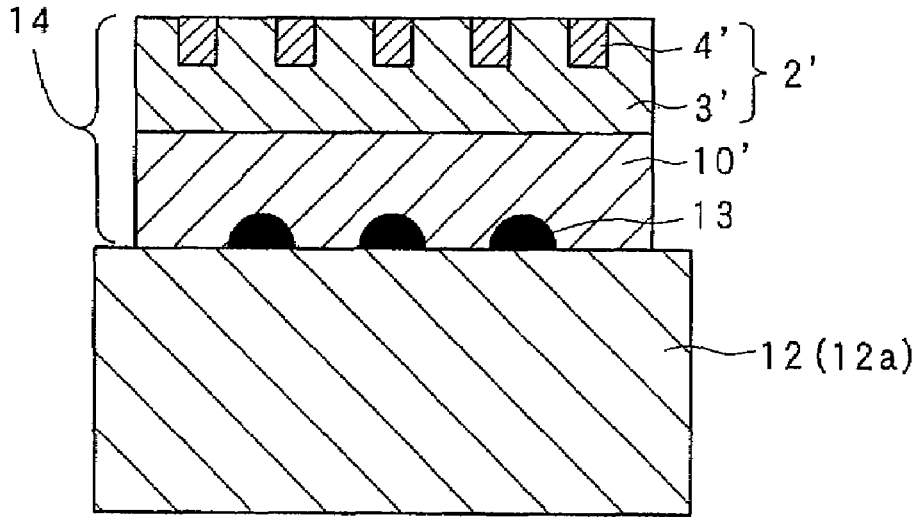
FIG. 19 is a sectional view showing another embodiment showing a condition after a hiding part is thermally transferred to the information recorded in advance on a transfer-receiving material by using a scratch layer transfer sheet according to the present invention.

FIG. 19 is a schematical sectional view showing the condition after the hiding part 14 is thermally transferred to a card 12*a* as the transfer-receiving material 12, on which card an information 13 is recorded in advance, by using the above thermal transfer sheet 112 of the present invention. The information 13 is recorded in the raised state on the surface of the leveled surface of the card. A protective layer 10' is thermally transferred to the print surface including the raised part and the unrecorded part to hide the recorded information 13. Further, the protective layer 10' is coated with a scratch layer 2' comprising a pattern layer 4' provided pattern-wise and a hiding layer 3' to form a hiding part-14. In this case, the hiding part 14 has a layer structure in which the protective layer 10' and the scratch layer 2' are laminated. The irregularities of the surface are leveled by coating the print surface of the transfer-receiving material 12 with the protective layer 10', it is possible to prevent the recorded information 13 from being read on account of the rise of the information section by coating the protective layer 10' with the scratch layer 2'. Further, even if the print surface of the transfer-receiving material is seen through, the recorded information 13 cannot be read since the hiding layer 3' exists.

Figure 20:
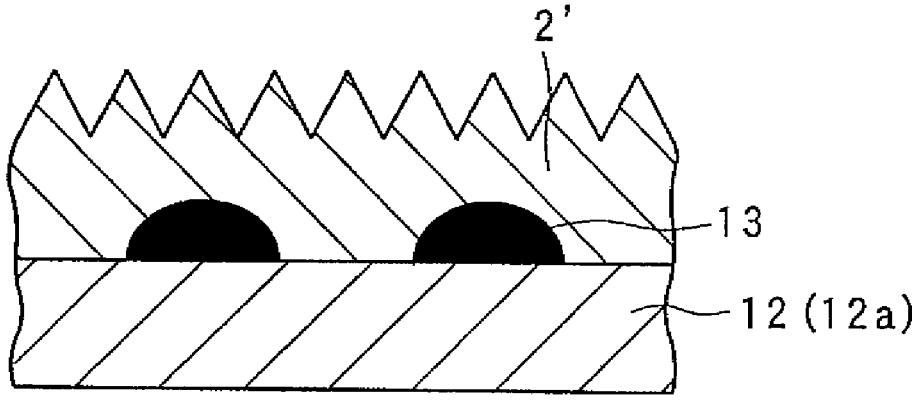
FIG. 20 is a sectional view showing another embodiment showing a condition after a hiding part is thermally transferred to the information recorded in advance on a transfer-receiving material by using a scratch layer transfer sheet according to the present invention.

FIG. 20 is a schematical sectional view showing the condition after the hiding part 14 is thermally transferred to a card 12*a* as the transfer-receiving material 12, on which card an information 13 is recorded in advance, by using the thermal transfer sheet 114 of the present invention. The information 13 is recorded in the raised state on the surface of the leveled surface of the card. The scratch layer 2' is transferred to the print surface including the raised part and the unrecorded part (which means the remainder part of the print surface excluding the part of the recorded information 13, the same as follows) to hide the recorded information 13. Also, the surface of the transferred scratch layer 2' is the boundary of a non-transferable matt layer and can be therefore camouflaged by the matt-like irregular form. Therefore, the rise of the recorded information 13 cannot be read.

Figure 21:
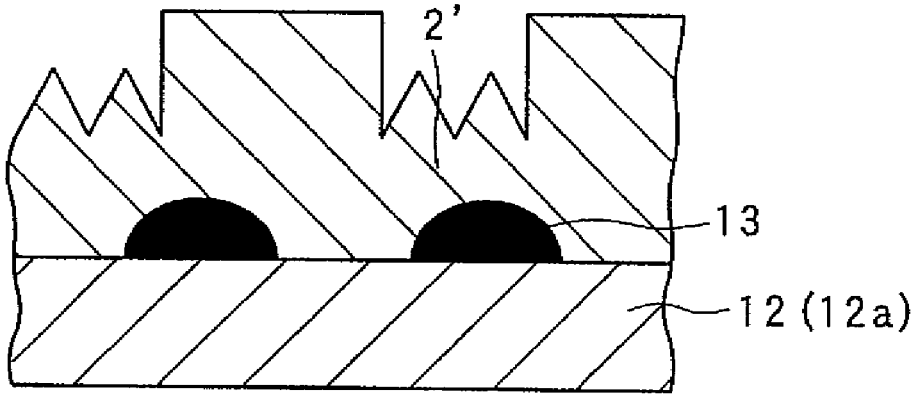
FIG. 21 is a sectional view showing another embodiment showing a condition after a hiding part is thermally transferred to the information recorded in advance on a transfer-receiving material by using a scratch layer transfer sheet according to the present invention.

FIG. 21 is a schematical sectional view showing the condition after the hiding part 14 is thermally transferred to a card 12*a* as the transfer-receiving material 12, on which card an information 13 is recorded in advance, by using the above thermal transfer sheet 115 provided with a transferable scratch layer through a matt layer having a predetermined pattern. The information 13 is recorded in the raised state on the surface of the leveled surface of the card. The scratch layer 2' is transferred to the print surface including the raised part and the unrecorded part to hide the recorded information 13. Also, the surface of the transferred scratch layer 2' is the boundary of a non-transferable matt layer and can be therefore camouflaged by the matt-like irregular form. Therefore, the rise of the recorded information 13 cannot be read. Also, in this example, the matt layer is provided in a predetermined pattern form and the surface of the transferred scratch layer 2' is formed such that the difference in level between the matted pattern section which has been the boundary of the matt layer and the smooth and glossy pattern section which has been the boundary of the substrate film is almost the same as the film thickness of the matt layer 11. Therefore, it is more difficult to read the rise of the recorded information 13.

(Substrate Film)

As the substrate film 1 of the thermal transfer sheet, any material may be used as far as it is a conventionally known material having a certain degree of heat resistance and strength. Examples of these materials include a polyester film, polystyrene film, polypropylene film, polysulfone film, alamide film, polycarbonate film, polyvinyl alcohol film and cellophane each having a thickness of about 0.5 to 50 μm and preferably 2 to 10 μm. A polyester film is particularly preferable.

(Matt Layer)

The matt layer may be formed using ink containing a binder resin and a matt agent (comprising fine particles). As the binder resin, anyone of resins having a certain degree of heat resistance and film-forming ability may be used. Given as examples of materials used as the binder resin are thermoplastic resins including polyolefin type resins such as polyethylene and polypropylene, polyester type resins, polyvinyl acetate resins, styrene/acrylate type resins, polyurethane type resins, polystyrene type resins, polyvinyl chloride type resins, polyether type resins, polyamide type resins, polycarbonate type resins, polyacrylate type resins, polyacrylamide type resins and polyvinylacetal type resins such as polyvinylbutyral and polyvinylacetoacetal and silicone modified products of these resins or mixtures of these materials.

As the matt agents, various known materials may be used. Given as examples of the matt agents are silica powder, silica powder treated with silane, talc powder, calcium carbonate powder, sedimentous barium sulfate powder, alumina powder, acid clay powder, clay powder, magnesium carbonate powder, potassium titanate powder, carbon black, tin oxide powder, titanium white powder, synthetic nitrogen mica powder, silicon powder, acrylic resin crosslinking powder, styrene-acryl resin crosslinking powder, epoxy resin crosslinking powder, porous polyurethane resin crosslinking powder, melamine-resin crosslinking powder, benzoguanamine resin crosslinking powder, urea resin crosslinking powder, silane-treated starch, aminoplasto crosslinking starch, epichlorohydrin crosslinking starch, phosphoric acid crosslinking starch and acrolein crosslinking starch.

The matt layer containing the above binder resin and matt agent is formed on a substrate film. The matt layer remains unpeeled from the substrate film when thermal transfer is made. Namely, the matt layer is a non-transferable layer and is therefore formed such that it has high adhesion to the substrate film. For example, measures may be taken in which the substrate film itself is subjected to corona discharge treatment or primer treatment to provide high adhesion between the substrate film and the matt layer or as the binder resin of the matt layer, one having high adhesion to the substrate film is selected.

The transferable scratch layer formed on the substrate film of the scratch layer transfer sheet through the non-transferable matt layer is transferred to the information section. The surface of the scratch layer after transfer is resultantly provided with the shape of the interface of the matt layer, namely provided with matt-like irregularities, which can prevent such an event, that the recorded information is read on account of the rise of a coloring agent, by three-dimensional hiding ability.

In addition, the matt layer may be formed either entirely or pattern-wise on the substrate film. If the matt layer is formed particularly like a pattern in which fine patterns are continuously repeated, a difference in matted feeling of the surface of the transfer-receiving material can be made more complicated and therefore the reading of the information can be made more difficult.

The above matt layer is formed entirely or pattern-wise on the substrate film by preparing a coating solution formulated with a binder resin, a matt agent and, as required, other additives and by applying the coating solution in a coating amount of about 0.05 to 5.0 g/m$^2$ and preferably 0.5 to 1.5 g/m$^2$ when dried by using a conventionally known method such as gravure coating, gravure reverse coating or roll coating. When the coating amount is excessively small, the rise of the recorded information is made distinguishable, producing only insufficient hiding effect. On the other hand, when the coating amount is excessively large, the peeling of the scratch layer from the substrate film in the thermal transfer step when the matt layer is formed pattern-wise is made unstable and a large amount of print energy is required in the thermal transfer step. Therefore, an amount out of the above range is undesirable.

Although no particular limitation is imposed on the design of the pattern, examples of the type of pattern include a pattern in which patterns obtained by arranging or overlapping wave line patterns having a line width of 0.1 to 3.0 mm and a length which varies in a range from 0.1 to 20 cm regularly or irregularly are respectively formed at cyclic intervals of about 0.5 to 20 cm such that each joint portion is made indistinguishable.

(Transferable Scratch Layer)

The thermal transfer sheet of the present invention is constituted by disposing the transferable scratch layer 2 which can hide the recorded information of the transfer-receiving material and can be scraped off from the transfer-receiving material to be removed, on the substrate film.

The transferable scratch layer 2 is disposed on the substrate film either directly or through the non-transferable matt layer. Although the transferable scratch layer 2 may be formed only of the hiding layer, it is preferably formed by combining the hiding layer 3 with the peeling layer 5 and/or the peeling layer 6, the pattern layer 4, the adhesive layer 7 and the like.

(Hiding Layer)

The hiding layer 3 provided in the scratch layer transfer sheet of the present invention has the ability to work as a hiding part after being transferred to the transfer-receiving material and has the following functions.

Specific examples of these functions include:

(1) optical hiding (or concealing) ability in order not to see through the information recorded in advance on the transfer-receiving material;

(2) three-dimensional hiding (or concealing) ability to make unclear the rise (irregularities) of the part of the information recorded in advance on the transfer-receiving material;

(3) proper adhesive force which is sufficient to prevent peeling when the thermal transfer sheet is handled and allows the hiding layer to be easily scraped off when the hiding layer is scratched by a nail or the like; and (4) cohesive force enough to be transferred to the transfer-receiving materials, such as cards, which are highly smooth and hard.

For the hiding layer, it is preferable to use a hiding material such as an aluminum pigment and a binder such as wax or a thermoplastic resin to exhibit the above functions sufficiently.

Examples of the hiding material include highly hiding metal pigments such as zinc powder, aluminum pigments and metal powder (e.g., brass and copper), titanium type white pigments, carbon black, organic white pigments and color pigments.

As the pigment, any pigment having high hiding ability may be used. Particularly aluminum pigments are useful in view of color including tone and chroma because it has high hiding ability, and in addition it produces no dirty shavings. Examples of the aluminum pigment include leafing type and non-leafing type aluminum powder pigments having an average particle diameter of 0.1 to 100 μm.

The hue of the hiding layer is not limited to the hue exhibited by the hiding material itself, but may be properly controlled by adding a coloring agent. Particularly, it is preferable to make a difference in hue between the coloring agent transfer layer forming the information recorded section and the transferable scratch layer in the point that separate application areas of each layer are easily found when the thermal transfer sheet is produced, thereby improving, for example, the operability of separate applications.

The hiding layer may be formed using any type of ink selected from heat meltable inks and solvent-dilution type inks. When the hiding layer is formed using heat meltable ink, various waxes and a thermoplastic resin are primarily contained. Examples of the waxes include microcrystalline wax, carnauba wax and paraffin wax. Further, various waxes such as Fisher-Tropsch wax, various low molecular polyethylene, haze wax, beeswax, spermaceti wax, insect wax, wool wax, shellac wax, candelilla wax, petrolatum, polyester wax, partially denatured wax, fatty acid ester and fatty acid amide may be used.

As the thermoplastic resin used in the aforementioned heat meltable ink hiding layer, besides an ethylene/vinyl acetate copolymer resin, a vinyl chloride/vinyl acetate copolymer resin, acrylic resin, polyester type resin, polyamide type resin, polyolefin type resin or the like may be used.

The hiding layer is preferably formed using a heat meltable ink containing primarily various waxes and an ethylene/vinyl acetate copolymer resin as the binder and an aluminum pigment and carbon black as the pigment with the intention of absorbing the irregularities of the recorded information section to be hidden, making the underlying information indistinguishable.

The mixing ratio of the wax to the thermoplastic resin such as an ethylene/vinyl acetate copolymer resin is preferably 20 to 0.5/1 (wax/thermoplastic resin) in terms of weight ratio. If the ratio of the thermoplastic is excessively large, the absorption of the irregularities of the hidden information section is made insufficient and the ability of optically hiding the underlying recorded information is dissatisfied. Also, the melt viscosity exceeds the range adaptable to hot melt coating of the hiding layer.

On the other hand, an excessively large ratio of the wax gives rise to the problem of small cohesive force insufficient to transfer the thermal transfer sheet to transfer receiving materials, such as cards, which are highly smooth and hard, whereby the recording cannot be achieved.

Next, as to the mixing ratio of the hiding material to the binder, an excessively large ratio of the hiding material causes disorders such as reduced sensitivity and the occurrence of voids when a printing operation is performed. On the other hand, if the ratio of the binder is excessively large, the coating amount must be increased to obtain sufficient optical hiding ability, with the result that coating adaptability, printing sensitivity, printing sharpness and the like are impaired. Therefore, both the hiding material and the binder must be mixed in a well-balanced manner.

For example, the ratio of the pigment containing primarily an aluminum pigment and carbon black to the binder containing primarily wax and an ethylene/vinyl acetate copolymer resin is preferably 1/4 to 1/0.5 in terms of weight ratio (pigment/binder).

The hiding layer comprising heat meltable ink contains the aforementioned hiding material and binder as its major components. Besides the above components, additives are added according to the need and the resulting coating solution is applied in an amount of about 0.5 to 10 $g/m^2$ and particularly preferably 1 to 7 $g/m^2$ when dried by using a hot melt coating method. In this case, as a standard for obtaining optically sufficient hiding ability, the hiding layer desirably secures a sufficient transmission density, specifically 1.0 or more and preferably 1.5 or more, in the case of using a black filter in the situation where the hiding layer is incorporated into the thermal transfer sheet.

When the hiding layer is formed using solvent dilution type ink, the hiding layer is constituted using primarily various thermoplastic resins. As the thermoplastic resin, a conventionally known resin is used and it is preferable to use a rubber type resin to impart scratch ability. As such a rubber type resin, resins having an elastic modulus ranging from $10^4$ to $10^8$ e Pa at 50° C. are preferable in view of adhesive easiness, scratch-off aptitude (scraping easiness) and printing sensitivity. Examples of such a resin include an ethylene/vinyl acetate copolymer resin, butadiene/acrylonitrile rubber, styrene/butadiene rubber, rubber chloride, ester rubber, polyisobutyrene rubber, butyl rubber and single, modified or copolymer products of an olefin resin, acrylic resin, urethane resin or the like.

Also, as the binder, not these rubber type resins but conventionally known thermoplastic resins may be used. Examples of the thermoplastic resin include cellulose derivatives such as ethyl cellulose and cellulose acetate butyrate, styrene copolymers such as polystyrene and poly α-methylstyrene, acrylic resins such as polymethylmethacrylate, polyethylmethacrylate and polyethylacrylate, vinyl type resins such as polyvinyl chloride, polyvinyl acetate, ethylene/vinyl acetate copolymers, vinyl chloride/vinyl acetate copolymers and polyvinylbutyral, polyester resins, nylon resins, epoxy resins, polyurethane type resins, ionomers, ethylene/acrylic acid copolymers, ethylene/acrylate, polyamide resins and olefin resins such as polyolefin chloride. However, when these thermoplastic resins are used, scratch-off aptitude is reduced. It is therefore preferable to improve the scratch-off aptitude by adding waxes or disposing an adhesive layer primarily containing a rubber type resin.

Also, in the case of the above solvent dilution type ink, various waxes may be added to improve adhesive easiness, scratch-off aptitude (scraping easiness) and printing sensitivity. However, an excessively large amount gives rise to the problems such as difficult scraping and decreased cohesive force insufficient to transfer the thermal transfer sheet to transfer-receiving materials, such as cards, which are highly smooth and hard.

In the hiding layer comprising solvent dilution type ink, the mixing ratio of the hiding material to the binder is preferably 5/1 to 1/4 in terms of weight ratio (hiding material/binder). The larger the ratio of the hiding material is, the more greatly the hiding ability can be improved. However, an excessively large amount causes reduced sensitivity and the occurrence of voids during printing. On the other hand, if the ratio of the binder is too large, the coating amount must be increased to obtain sufficient optical hiding ability, resulting in impaired coatability, printing sensitivity and printing sharpness.

The hiding layer comprising solvent dilution type ink contains the aforementioned hiding material and binder as its major components. Besides the above components, other additives are added according to the need and the resulting coating solution is applied in an amount of about 0.5 to 10 $g/m^2$ and particularly preferably 1.0 to 5.0 $g/m^2$ when dried by using a coating method such as gravure coating, gravure reverse coating or roll coating method. In this case, as a standard for obtaining optically sufficient hiding ability, the hiding layer desirably secures a sufficient transmission density, specifically 1.0 or more and preferably 1.5 or more, in the case of using a black filter in the situation where the hiding layer is incorporated into the thermal transfer sheet.

Also, in the thermal transfer sheet of the present invention, the area of one partition of each of the transfer scratch layer and the coloring agent transfer layer which are alternately applied separately side by side may be arbitrarily selected. The both areas are preferably the same taking the purpose for general-use into consideration.

Also, the area coated in one partition of the transfer scratch layer section is preferably in a range from 30 to 150% of the maximum area of the print surface of the transfer-receiving material. The transferable scratch layer in which the area of one partition falls in the above proportion ensures that the information record section of the transfer-receiving material can be hidden effectively with a high design quality.

(Pattern Layer)

In the thermal transfer sheet of the present invention, the transferable scratch layer 2 may comprise the transferable pattern layer 4 provided with a predetermined pattern form including at least a firm name, logo and specific mark and the hiding layer 3.

In this case, the thermally transferable pattern layer and hiding layer are laminated on the substrate film in this order from the side close to the substrate film to form the transferable scratch layer.

The pattern layer contains at least one binder selected from waxes and thermoplastic resins. Examples of the wax include microcrystalline wax, carnauba wax and paraffin wax. Further, various waxes such as Fisher-Tropsch wax, various low molecular polyethylene, haze wax, beeswax, spermaceti wax, insect wax, wool wax, shellac wax, candelilla wax, petrolatum, polyester wax, partially denatured wax, fatty acid ester and fatty acid amide may be used.

Given as examples of the thermoplastic resin binder are acrylic resins, polyester type resins, polyamide type resins, polyolefin type resins, styrene type resins, vinyl chloride/vinyl acetate copolymers, ethylene/vinyl acetate copolymers and thermoplastic elastomers such as styrene/butadiene rubber.

In addition, the pattern layer may contain various conventionally known coloring agents. As the coloring agent, organic or inorganic pigments or those having good characteristics as recording materials among dyes, for example, those which have sufficient color density and are neither changed in color nor faded by light, heat or temperature are preferable. As the coloring agent, hues such as cyan, magenta, yellow and black may be optionally selected. Also, pigments having metallic glossiness such as a gold color, silver color and copper color, inorganic or organic pigments having fluorescence, dyes and pigments or dyes having a white type color or an intermediate color such as green, orange and violet may be used.

The pattern layer is disposed with the intention of imparting three-dimensional and visual hiding ability which makes indistinguishable the irregularities of the part of the information recorded in advance on the transfer-receiving material which intention cannot be accomplished by only the hiding layer. Therefore, the scratch layer in which the hiding layer and the pattern layer are laminated in this order from the side close to the print surface is disposed on the print surface of the transfer-receiving material, whereby the through-vision preventive action of the hiding layer is combined with the surface camouflage action of the pattern layer to further improve the hiding effect.

The pattern layer serves to prevent the information from being read on account of the rise of the information record section on the transfer-receiving material provided that two layers consisting of the pattern layer and the thermal transfer ink layer for scratching or two layers consisting of the pattern layer and the peeling layer are intermingled on the surface of the transfer-receiving material. Also, the structure involving a coloring agent can make it difficult to read the information visually by a difference in hue and due to its pattern. Also, the structure involving a coloring agent can make it difficult to read the information visually and optically by a difference in hue and due to the pattern and the rise of the irregularities of the pattern layer itself.

If a structure in which a coloring agent is contained in the pattern layer is adopted, each of the pattern layer, the peeling layer and the hiding layer may contain primarily either one of a thermoplastic resin and wax.

In the case of containing a coloring agent in the pattern layer, a coloring agent having the same hue as that of the information record section or a hue similar to that of the information record section to be hidden under the pattern layer is added, whereby the information record section placed under the pattern layer can be hidden, making it more difficult to distinguish the information.

In this manner, the color pattern layer produces the effect of preventing the reading of the hidden information by a color pattern and the effect of preventing the reading of the hidden information three-dimensionally by differences in gross feeling and matt feeling (differences from those of the surface to which the protective layer and the hiding layer are transferred) on the surface to which the pattern layer is transferred whether it is colored or non-colored.

In the area forming the pattern layer, a striped pattern, wave line pattern or diced pattern is formed, a dot pattern is formed or a pattern including a firm name, logo and specific mark is formed and these patterns may be formed while the shape of the pattern is optionally changed. Also, the pattern layer is preferably formed so as to prevent the recorded information from being read even if it is intended to see through the information from the above and to read the information by observing the surface gloss.

As the pattern, a pattern in which patterns obtained by arranging or overlapping wave line patterns having a line width of 0.1 to 3.0 mm and a length which varies in a range from 0.1 to 20 cm regularly or irregularly are respectively formed at cyclic intervals of about 0.5 to 20 cm such that each joint portion is made indistinguishable is preferable because this structure makes it difficult to read the information visually.

If a pigment having high hiding ability such as carbon black, aluminum pigments or titanium oxide in the case of containing a coloring agent in the pattern layer, the underlying information can be hidden more exactly. Also, if a color material having the same hue as the underlying information section or a hue similar to that of the information section is used, a coloring hiding effect can be produced.

The aforementioned pattern layer contains a binder and a coloring agent as required. Besides the above components, other additives are added according to the need and the resulting coating solution is applied in an amount of about 0.05 to 5.0 g/m$^2$ and particularly preferably 0.2 to 1.5 g/m$^2$ when it is dried by using a hotmelt coating, hot lacquer coating, gravure coating, gravure reverse coating, knife coating, air coating or roll coating method. The coating amount meant here is a weight per 1 m$^2$ when only the coated part of the pattern layer is picked up and is different from an actually measured weight per 1 m$^2$ of an actual sample including the coated part and non-coated part. Namely, the coating amount is determined by calculating from the weight per 1 m$^2$ of an actual sample and the pattern ratio.

When the amount of the pattern layer to be applied is less than 0.05 g/m$^2$, the irregularities of the underlying recorded information section becomes distinguishable whereas when the amount exceeds 5.0 g/m$^2$, the pattern layer is not peeled stably when it is thermally transferred.

Also, when the area occupied by the pattern layer is compared with the area occupied by the hiding layer disposed thereon, the ratio (pattern ratio) of the area occupied by the pattern layer is preferably 5 to 95% and more preferably 5 to 85% per area of 2 cm$^2$ of the scratch layer transferred using the scratch layer transfer sheet. The section (information record section) of the transfer-receiving material on which section printing is made in advance can be well hidden by the scratch layer on which the pattern layer and the hiding layer are laminated. The above ratio is based on the area (100%) of the scratch layer.

Also, the aforementioned pattern ratio is the ratio of the area of the transferred-section (pattern section) of the pattern layer per area of 2 cm$^2$ of the scratch layer transferred using the thermal transfer sheet of the present invention. This pattern ratio is the same as the ratio of the area occupied by the pattern layer to the transferable scratch layer (100%) per area of 2 cm$^2$ in the situation where the pattern layer is incorporated into the thermal transfer sheet.

Figure 22:
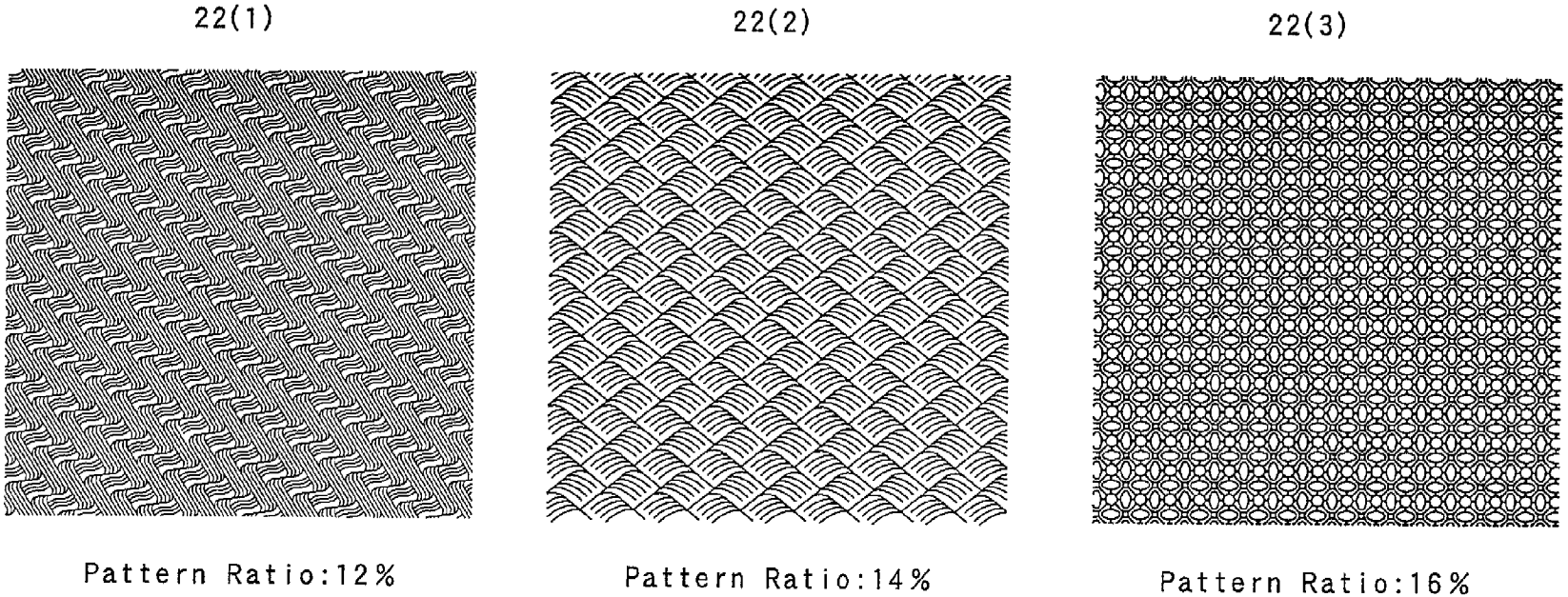
FIG. 22 is a view showing an example of a pattern of a pattern layer.

Given as examples of the pattern of the pattern layer are those shown in FIG. 22. As to the aforementioned ratio of the coated area of the pattern layer/the coated area of the hiding layer=pattern ratio (%), the pattern ratio is 12% in the case of the pattern shown in FIG. 22 (1), 14% in the case of the pattern shown in FIG. 22 (2) and 16% in the case of the pattern shown in FIG. 22 (3). In a method of measuring the pattern ratio, an actually transferred pattern is read using a scanner to make image data, which is read using a software, such as, for example, Photoshop (trade name) of Adobe corporation, which distinguish 256 gradations of each pixel to read the ratio of the pattern section from the histogram of 256 gradations of each pixel. This ratio is the pattern ratio.

(Peeling Layer)

In the thermal transfer sheet of the present invention, the peeling layer 5 may be formed between the substrate film 1 and the transferable scratch layer 2, between the substrate film 1 and the transferable protective layer 10 or between the substrate film 1 and the heat meltable ink layer 9*a* to thereby make it easy to peel off the scratch layer, protective layer and heat meltable ink layer 9*a* from the substrate film 1 during thermal transfer. Also, when the scratch layer 2 has a multi-layer structure, the second peeling layer 6 may be formed between the hiding layer 3 and the pattern layer 4 to make it more difficult to see through the information. These peeling layers 5 and 6 constitute a part of the scratch layer, protective layer and heat meltable ink layer.

The peeling layer is a layer having the following characteristics. Specifically, all of the layer or a part of the layer separated in the direction of thickness caused by cohesive failure is transferred and transited to the transfer-receiving material from the thermal transfer sheet. In the case of transition of all or a part, the layer preferably has a low cohesive force during recording so that well layer-cuttability during printing is obtained. Alternatively, a layer which is neither transferred nor transited may be used. In short, the peeling layer is a layer which enables the peeling of the thermal transfer sheet at a position therein or at an interface next to the upper or lower side thereof to thereby allow a layer disposed on the substrate film to separate from the substrate film.

To state in detail, the above scratch layer preferably has the following structure: substrate film/peeling layer/pattern layer/hiding layer.

For the peeling layer, various waxes such as carnauba wax, paraffin wax, microcrystalline wax, ester wax, Fisher-Tropsch wax, various low molecular polyethylene, haze wax, beeswax, spermaceti wax, insect wax, wool wax, shellac wax, candelilla wax, petrolatum, partially denatured wax, fatty acid ester and fatty acid amide may be used.

For the peeling layer, resins in addition to the above waxes may be used as far as these resins have the proper ability to peel from the substrate. Only a resin or a mixture of the above waxes and a resin may be used. Examples of such a resin include rubber type resins such as polyisoprene rubber, styrene-butadiene rubber and butadiene-acrylonitrile rubber, acrylate type resins, polyvinyl ether type resins, polyvinyl acetate type resins, vinyl chloride/vinyl acetate copolymer type resins, polystyrene type resins, polyester type resins, polyamide type resins, polyimide type resins, polyolefin chloride type resins, polycarbonate and polyvinylbutyral type resins.

If the peeling layer is constituted of, primarily, a resin having a Tg of 100° C. or more such as, particularly, an acrylic resin, cellulose resin, acetal resin or polyolefin chloride resin, this produces the effect of scraping off the scratch layer with ease.

Also, a conventionally known coloring agent may be compounded in the peeling layer for the purpose of supplement the hiding ability.

The peeling layer may be formed by a conventionally known method such as a gravure coating, gravure reverse coating or roll coating method. The thickness of the peeling layer is generally in a range from 0.1 to 10 g/m$^2$ as the coating amount. If the thickness is less than 0.1 g/m$^2$, a function as peeling layer is not fulfilled whereas if the thickness exceeds 10 g/m$^2$, the layer-cuttability during printing is deteriorated and also layer-maintainability is reduced, with the result that the produced peeling layer cannot be used occasionally.

The peeling layers 5 and 6 may be formed on the substrate film or the pattern layer wholly or pattern-wise. When the peeling layer 5 is formed wholly on the substrate film, the transfer stability can be improved. Also, when the peeling layer 6 is formed wholly on the surface of the pattern layer, differences in glossiness and hue from the pattern layer on the surface of the transfer-receiving material can be provided, making it more difficult to read the information.

(Adhesive Layer)

The thermal transfer sheet of the present invention can be improved in the transferability of each of the scratch layer, the protective layer and the heat meltable ink layer to the transfer-receiving material, in adhesive easiness and in scratch-off aptitude during thermal transfer by forming an adhesive layer on the transferable scratch layer 2, the transferable protective layer 10 or the heat meltable ink layer 9*a*. These adhesive layers constitute apart of the scratch layer, protective layer or heat meltable ink layer.

The adhesive layer may use a thermoplastic resin, natural resin, rubber or wax in general. Examples of these materials include cellulose derivatives such as ethyl cellulose and cellulose acetate butyrate, styrene copolymers such as polystyrene and poly α-methylstyrene, acrylic resins such as polymethylmethacrylate, polyethylmethacrylate and polyethylacrylate, vinyl type resins such as polyvinyl chloride, polyvinyl acetate, ethylene/vinyl acetate copolymers, copolymers of an ethylene monomer, vinyl acetate monomer and other monomers, vinyl chloride/vinyl acetate copolymers and polyvinylbutyral, polyester resins, nylon resins, epoxy resins, polyurethane type resins, ionomers, ethylene/acrylic acid copolymers, ethylene/acrylate, polyamide resins, olefin resins such as polyolefin chloride and rubbers such as ester rubber, polyisobutylene rubber, butyl rubber, styrene/butadiene rubber, butadiene/acrylonitrile rubber or rubber chloride, and modified or copolymer products of these materials.

As the material for the adhesive layer, particularly a rubber type resin is preferably used to improve, for example, the transferability of each of the scratch layer and the protective layer to the transfer-receiving material, adhesive easiness, scratch-off aptitude and adaptability to rough paper (so as to make it possible to print uniformly on the irregularities of the part of the recorded information section). As the rubber type resin to be used, resins having an elastic modulus ranging from $10^4$ to $10^8$ Pa at 50° C. are preferable in view of adhesive easiness, scratch-off aptitude (aptitude making it possible to scrape off the hiding part easily by a nail or a coin) and printing sensitivity.

Particularly, in the adhesive layer of the transferable scratch layer, an ethylene/vinyl acetate copolymer resin or its modified product or a copolymer of an ethylene monomer, a vinyl acetate monomer and other monomers is preferably used as the rubber type resin in view of the scratch-off aptitude of the thermal transfer sheet of the present invention.

Waxes may be added to the adhesive layer to improve, for example, transfer sensitivity, the fluidity of ink, scratch-off aptitude and adaptability to rough paper. The thickness of the adhesive layer is about 0.05 to 5.0 g/m$^2$ and particularly preferably 0.5 to 3.0 g/m$^2$ in a dry condition. The adhesive layer may be formed by applying and drying in the same manner as in the production of the above ink layer.

(Coloring Agent Transfer Layer)

In the present invention, the coloring agent transfer layer 9 may be formed on the substrate film 1 of the scratch layer transfer sheet such that the coloring agent transfer layer 9 and the above transferable scratch layer are alternately provided side by side.

As the coloring agent transfer layer, a heat meltable ink layer or a sublimation dye layer may be used. In the present invention, the information can be hidden so that the information cannot be read from the above of the hiding layer not only in the case where no rise of the coloring agent takes place on the print surface of the transfer-receiving material like the case of using the sublimation dye layer but also in the case where a rise of the coloring agent takes place on the print surface of the transfer-receiving material like the case of using the heat meltable ink layer. Therefore, the scratch layer transfer sheet of the present invention produces a particularly excellent hiding effect in the case of recording information on the print surface by using a heat meltable ink and coating the information and therefore has high utility value.

As the heat meltable ink layer, a type comprising a conventionally known coloring agent and binder and formulated with various additives such as mineral oil, vegetable oil, higher fatty acid such as stearic acid, a plasticizer, a thermoplastic resin and a filler may be used. As the wax to be used as the binder, microcrystalline wax, carnauba wax and paraffin wax are exemplified. Further, various waxes such as Fisher-Tropsch wax, various low molecular polyethylene, haze wax, beeswax, spermaceti wax, insect wax, wool wax, shellac wax, candelilla wax, petrolatum, polyester wax, partially denatured wax, fatty acid ester and fatty acid amide may be used. Among these waxes, those having a melting point of 50 to 85° C. are preferable. A melting point less than 50° C. gives rise to a problem concerning preservation ability whereas a melting point exceeding 85° C. causes insufficient sensitivity.

Examples of the resin component to be used as the binder include an ethylene/vinyl acetate copolymer, ethylene/acrylate copolymer, polyethylene, polystyrene, polypropylene, polybutene, petroleum resin, vinyl chloride resin, vinyl chloride/vinyl acetate copolymer, polyvinyl alcohol, vinylidene chloride resin, methacrylic resin, polyamide, polycarbonate, fluororesin, polyvinylformal, polyvinylbutyral, acetyl cellulose, nitro cellulose, polyvinyl acetate, polyisobutylene, ethyl cellulose and polyacetal. Among these resin materials, those used as a hot melt adhesives having a relatively low softening point, for example, a softening point of 50 to 80° C., are preferable.

The coloring agent may be optionally selected from among known organic or inorganic pigments or dyes. For example, those which have sufficient coloring density and are neither changed in color nor faded by light, heat or the like are preferable. As a black pigment, carbon black is preferably used. Also, a material which develops a color by heating or a material which develops a color when it is brought into contact with the components applied to the surface of the transfer-receiving material may be used. Further, the color of the coloring agent is not limited to cyan, magenta, yellow or black and coloring agents having various colors may be used.

The coloring agent transfer layer of the thermal transfer sheet of the present invention may be those which are optically distinguishable using invisible light. For instance, infrared absorbing materials or fluorescent materials may be contained in the heat meltable ink layer and coloring agents distinguishable by light including infrared rays or ultraviolet rays and excluding visible light may be contained in the ink layer. An ink layer of this type has the effect of preventing forgery and alteration because the data of the information which is thermally transferred and recorded is indistinguishable by visible light but is distinguishable by irradiating with infrared rays or ultraviolet rays. For this, in the present invention, a coloring agent which is indistinguishable by visible light but optically distinguishable using invisible light may be used.

The above infrared absorbing materials mean materials having absorption in the near infrared region to the infrared region. Specific examples of these materials include carbon, copper oxide, ferrous oxide, Yb (ytterbium) compounds, cyanine type dyes, naphthoquinone type dyes, anthraquinone type dyes, phthalocyanine type dyes, naphthalocyanine type dyes, indophenol type dyes and Ni-dithiol complexes.

The fluorescent materials mean those having the characteristics that they are excited by sun light, electric light or ultraviolet rays to absorb energy and convert the energy into light during excitation to emit light (fluorescent light). These fluorescent materials are usually used as particles, namely in the form of a fluorescent pigment. Also, the fluorescent materials include inorganic fluorescent materials and organic fluorescent materials. The inorganic type fluorescent materials include pigments obtained by using a crystal of an oxide, sulfide, silicate, phosphate or tungstate of Ca, Ba, Mg, Zn or Cd as major components and by adding a metal element such as Mn, Zn, Ag, Cu, Sb or Pb or a rare earth element such as lanthanoids as an activator, followed by baking. Given as specific examples of compounds of these inorganic fluorescent materials are fluorescent materials including oxide types such as calcium tungstate and magnesium tungstate, sulfide types such ascalciumsulfide•bismuth, zinc sulfide•silver, zinc sulfide•copper and zinc sulfide•gold•aluminum and oxide types such as zinc oxide•zinc, yttrium vanadate•europium, yttrium oxide•europium, yttrium sulfate•europium, yttrium sulfate•terbium, gadolinium sulfate•terbium, lanthanum sulfate•terbium and lanthanum oxide bromide•terbium.

Given as examples of the organic type fluorescent material are diaminostilbenedisulfonic acid derivatives, imidazole derivatives, cumalin derivatives, derivatives of triazole, carbazole, pyridine, naphthalic acid or imidazolone, dyes such as Fluorescein and Eosine and compounds having a benzene ring such as anthracene. Usually, as the organic type fluorescent material, those made into fluorescent pigments by dissolving the fluorescent material in a transparent resin such as an acrylic resin or melamine resin and by powdering the resulting product are used.

A heat conductive material may be compounded as a filler of the binder in the heat meltable ink layer to provide high heat conductivity and heat melt transferability. Examples of such a filler include carbonic materials such as carbon black, metals or metallic compounds such as aluminum, copper, tin oxide and molybdenum disulfide. The heat meltable ink layer is formed by applying a coating solution for the formation of a heat meltable ink layer, which solution is prepared by compounding the coloring agent component and a binder component as aforementioned and further solvent components such as water or an organic solvent, by using a conventionally known hotmelt coating, hot lacquer coating, gravure coating, gravure reverse coating or roll coating method. Also, there is a method of forming the heat meltable ink by using a water type or non-water type emulsion coating solution. The thickness of the heat meltable ink layer must be determined in such a manner as to acquire balance between necessary printing density and heat sensitivity. The thickness of the heat meltable ink layer is in a range from 0.1 $g/m^2$ to 30 $g/m^2$ and preferably about 1 $g/m^2$ to 20 $g/m^2$.

The center plane average roughness SPa of the section in which the information is recorded on the transfer-receiving material in the measurement of three-dimensional roughness is preferably 10 μm or less after the recording by the above heat meltable ink layer. By setting the center plane average roughness SPa of the information record section to 10 μm or less, the surface irregularities of the information record section to be hidden is decreased to hide the information section exactly by the scratch layer transferred from the thermal transfer sheet and the possibility that the surface follows the irregularities of the section recorded on the transfer-receiving material and a difference in the surface glossiness of the section and the information record section is therefore read can be eliminated.

In the present invention, a Surfcom 570A-3DF manufactured by Tokyo Seimitsu was used to measure the center plane average roughness SPa in the measurement using a three-dimensional roughness shape measuring meter. The area for measurement was 1.5 cm×1.5 cm and a bold-faced character "B" with a size of 6 point according to a style of type, Times New Roman was recorded on a PVC (poly vinyl chloride resin) card to measure the center plane average roughness SPa. The recorded section as the position to be measured was the section which was thermally transferred to the PVC card from the thermal transfer sheet. If the center plane average roughness SPa is greater than 10 μm, it is difficult to hide the section recorded on the transfer-receiving material even if the scratch layer transfer sheet of the present invention is used.

(Transferable Protective Layer)

In the present invention, the transferable protective layer 10 may be formed on the substrate film 1 of the scratch layer transfer sheet such that the transferable protective layer 10 and the transferable scratch layer are alternately provided side by side to thermally transfer the surface protective layer to the transfer-receiving material on which the information is recorded in advance.

The protective layer levels the irregularities of the information record section of transfer-receiving paper during transfer. In short, it has the ability to fill and also prevents the background soiling of the recorded informed section.

Also, the protective layer is particularly effective in the point that scratch inferiors that the hiding layer cannot be scratched easily by an anchor effect in the case where a substrate of a medium on which information is recorded is a medium having low surface smoothness such as paper can be prevented. To mention in other words, the protective layer levels irregularities of the surface by filling to prevent the phenomenon that an adhesive of the scratch layer penetrates into pores of the surface of the medium and causes an anchor effect to be hardly peeled off and therefore scratching can be attained irrespective of the type of medium.

The transferable protective layer may have either a monolayer structure comprising only a main protective layer having the ability to protect the print surface on which the information is recorded on the transfer-receiving material or a multilayer structure in which the peeling layer or the adhesive layer is laminated on the main protective layer. The main protective layer is preferably constituted of wax and/or a thermoplastic resin and further an extender pigment may be added according to the need.

When the transferable protective layer of the thermal transfer sheet is constituted only of the main protective layer or constituted by laminating the peeling layer and the main protective layer in this order from the side close to the substrate film, it is preferable to set the melting point of the main protective layer to a range between 40 to 150° C. and the melting point of the peeling layer to a range between 40 to 300° C.

When the transferable protective layer is constituted by laminating the main protective layer and the adhesive layer in this order from the side close to the substrate film or by laminating the peeling layer, the main protective layer and the adhesive layer in this order from the side close to the substrate film, it is preferable to set the melting point of the main protective layer to a range between 40 to 300° C. and the melting point of the adhesive layer to a range between 40 to 150° C.

Typical examples of the wax to be preferably used in the main protective layer include microcrystalline wax, carnauba wax and paraffin wax. Further, various waxes such as Fisher-Tropsch wax, various low molecular polyethylene and partly denatured wax, fatty acid ester and amide, haze wax, beeswax, spermaceti wax, insect wax, wool wax, shellac wax, candelilla wax, petrolatum and vinyl ether type wax such as octadecyl vinyl ether.

Examples of the thermoplastic resin to be used for the main protective layer include polyethylene, polyethylene chloride, polyethylene chlorosulfonate, ethylene/vinyl acetate copolymers (EVA), ethylene/ethylacrylate copolymers (EEA), ionomers, polypropylene, polystyrene, styrene/acrylonitrile copolymers (AS resins), ABS resins, polyvinyl chloride, polyvinylidene chloride, vinyl chloride/acrylonitrile copolymers, vinylidene chloride/acrylonitrile copolymers, vinyl chloride/vinyl acetate copolymers, vinyl chloride/vinyl propionate copolymers, polyvinyl acetate, polyvinyl alcohol, polyvinylacetal, polybutene resins, acrylic resins, fluororesins, isobutylene/maleic acid anhydride copolymers, polyamide resins, nitrile rubber, acrylic rubber, polyisobutylene resins, polycarbonate resins, polyacetal resins, polyalkylene oxide, saturated polyester reins, silicon resins, phenol resins, urea resins, unsaturated polyester resins, diacryl phthalate resins, epoxy resins, polyurethane resins, denatured rosin, rosin, hydrogenated rosin, rosin ester type resins, maleic acid resins, ketonic resins, xylene resins, vinyltoluenebutadiene resins, polycaprolactone resins, ethyl cellulose resins, polyvinylformal resins, acetyl cellulose resins, maleic acid resins, vinyltolueneacrylate resins, terpene type resins, aliphatic, aromatic, copolymer or alicyclic type petroleum resins, cellulose derivatives such as methyl cellulose, hydroxyethyl cellulose and nitrocellulose and copolymers or blend polymers of these resins.

(Heat Resistant Layer)

The scratch layer transfer sheet as aforementioned is preferably provided with a heat resistant layer 8 on the backface thereof to exclude adverse influences such as sticking caused by the heat of a thermal head and printing wrinkles.

Resins for forming the aforementioned heat resistant layer may be conventionally known resins. Examples of the resins include polyvinylbutyral resins, polyvinylacetoacetal resins, polyester resins, vinyl chloride/vinyl acetate copolymers, polyether resins, polybutadiene resins, styrene/butadiene copolymers, acryl polyol, polyurethaneacrylate, polyester acrylate, polyether acrylate, epoxyacrylate, urethane or epoxy prepolymers, nitrocellulose resins, cellulose nitrate resins, cellulose acetopropionate resins, cellulose acetate butylate resins, cellulose acetate hydrodienephthalate resins, cellulose acetate resins, aromatic polyamide resins, polyimide resins, polycarbonate resins and polyolefin chloride resins.

For improving heat resistance, the resin forming the heat resistant layer may be a reaction product obtained by curing the above resin with various isocyanate hardeners or monomers or oligomers having an unsaturated bond. A hardening method involves heating and application of ionizing radiation and there is no limitation to the hardening measures.

Given as examples of a lubricant which is added or applied to the heat resistant layer comprising these resins are a phosphate, silicone oil, graphite powder, silicone type graft polymer, fluorine type graft polymer, acrylsilicone graft polymer, and silicone polymer such as acrylsiloxane and arylsiloxane. A layer comprising a polyol, for example, a polyalcohol high molecular compound, a polyisocyanate compound and a phosphate type compound is preferable and further a filler is more preferably added.

The heat resistant layer may be formed by the following method: the aforementioned resin, lubricant and filler are dissolved or dispersed in an appropriate solvent to prepare ink for forming a heat resistant layer and the ink is applied to the other surface of the aforementioned substrate film by using a forming measures such as a gravure printing method, screen printing method or reverse coating method using a gravure plate, followed by drying.

(Method of Producing a Scratch Print Product)

In the present invention, a scratch print product is obtained by providing a transfer-receiving material provided with a print surface on which information is recorded in advance and also providing a scratch layer transfer sheet provided with at least a transferable scratch layer on one surface of the substrate film and by overlapping the transferable scratch layer of the above scratch layer transfer sheet on the print surface of the above transfer-receiving material such that the scratch layer faces the print surface to transfer the above transferable scratch layer by heating. The information record section of the scratch print product is hidden by the scratch layer and the scratch layer can be removed from the information record section by scratching the scratch layer by a hand or a coin.

As the transfer-receiving material, the following materials may be used to make it difficult for the transferred ink layer to penetrate thereinto and to prevent the surface of the underlying transfer-receiving material from being damaged even if the transferred part of the scratch layer is scraped off. Examples of these materials include various plastic films and plastic cards made of resins such as a polyester resin, polyvinyl chloride resin, vinyl chloride/vinyl acetate copolymer resin, polycarbonate resin, polystyrene resin, acrylonitrile/butadiene/styrene copolymer resin, woven or nonwoven fabrics made of synthetic fiber such as polyester fiber, polyamide fiber, polypropylene fiber and vinylon fiber and synthetic paper and coated paper comprising a polypropylene resin or a polyester resin as its major components.

Measures for recording information in advance on the transfer-receiving material are not limited to the thermal transfer system in which the heat meltable ink layer is thermally transferred to record and may be a printing system using letterpress printing, off-set printing or gravure printing or may be a thermal transfer system using heat sublimation ink, ink jet recording system or electrophotographic system recording as on-demand printing.

Like the sublimation thermal transfer method, the heat melting thermal transfer method enables the recording of variable information. However, unlike the sublimation thermal transfer method, the heat melting thermal transfer method has a problem of a rise of ink on the information record section. According to the present invention, the rise of ink on the information record section made of the heat meltable ink can be hidden satisfactorily. Therefore, the method of producing a scratch print product of the present invention has particularly a method with high utility value when information is recorded by the heat melting thermal transfer.

The recording section must have heat resistance to evade the occurrence of the phenomenon that the recorded section is melted and changed in color depending on heating condition during heat transfer when the information record section provided in advance on the transfer-receiving material is hidden by the protective layer and the scratch layer.

In particular, in the case of thermally transferring the heat meltable ink layer to record information in advance on the transfer-receiving material, the material of the ink layer of the information record section must be selected in advance such that the protective layer and the scratch layer are transferred to the transfer-receiving material at a temperature lower than the temperature of the surface of the recorded section to be hidden at the time of thermal transfer of the heat meltable ink layer.

In the method of using the transfer-receiving material of the thermal transfer sheet according to the present invention, the center plane average roughness SPa of the section on which information is recorded in advance on the transfer-receiving material in the measurement of three-dimensional roughness is preferably 10 μm or less. By this measures, the surface irregularities of the information record section to be hidden is decreased to hide the information section exactly by the protective layer and scratch layer transferred from the thermal transfer sheet and the possibility that the surface follows the irregularities of the section recorded on the transfer-receiving material and a difference in the surface glossiness of the section and the recorded section is therefore read can be eliminated.

In the present invention, a Surfcom 570A-3DF manufactured by Tokyo Seimitsu was used to measure the center plane average roughness SPa in the measurement using a three-dimensional roughness shape measuring meter.

The area for measurement was 2.0 mm×2.0 mm and a bold-faced character "B" with a size of 6 point according to a style of type, Times New Roman was recorded on a PVC (poly vinyl chloride resin) card to measure the center plane average roughness SPa of the character "B". As the recording method, various printing systems including letterpress printing, off-set printing or gravure printing or a thermal transfer system were used. If the center plane average roughness SPa is greater than 10 μm, the section recorded in advance on the transfer-receiving material can be hidden insufficiently even if the transfer sheet of the present invention is used.

The scratch layer transferred to the recorded section of the transfer-receiving material from the thermal transfer sheet must be a type which can be easily scraped off when the scratch layer of the record section is scratched by a nail or a coin. On the other hand, it is required for the scratch layer not to be a type which is scraped off by the action exerted to the extent that it is rubbed by something when it is handled, although it is scraped off by scratching by a nail or a coin. Therefore, the scratch layer preferably has a level of HB or less as the pencil scratch value prescribed in the handwriting method of JIS K 5400 so that it is broken at such a scratch level. This ensures that a scratch layer well-balanced between proper adhesion to the transfer-receiving material and moderate fragility making it possible to scrape off the scratch layer when it is scratched by a nail or a coin is obtained.

The pencil scratch value prescribed in the handwriting method of JIS K5400 is found in the following manner: the hardness of the coating film of the scratch layer transferred to the transfer-receiving material is examined by scratching the coating film using a pencil lead and is expressed by the density mark of pencil. To mention specifically, a specimen is secured to the level surface of a table with the coating surface facing upward. A pencil kept at an angle of about 45 degrees with the level table is pushed forward about 1 cm at a constant rate in the front of a test operator while the pencil is pressed against the coating surface as strongly as possible to the extent that the lead is not broken to scratch the coating surface. The pushing rate is designed to be about 1 cm/s. The end of the pencil lead is newly sharpened every scratching and the test is repeated five times each using a pencil having the same density mark. When a breaking extending to the base or undercoat of the specimen is unobserved two or more times among five tests, the pencil is exchanged with a pencil having a density mark having a higher grade by one rank. The same test is undergone to find a pencil by which the breaking of the coating film is observed two or more times. The density mark having a lower grade by one rank than the density mark of the found pencil is determined as the pencil scratch value of the coating film.

As mentioned previously, the print surface of the transfer-receiving material on which the information is recorded is preferably coated with the scratch layer after it is coated with the protective layer in advance. The protective layer may be formed on the print surface, on which the information is recorded, either by applying a coating solution for a protective layer or by performing thermal transfer by using such a protective layer transfer sheet provided with a transferable protective layer as aforementioned.

In the present invention, it is preferable to form the coloring agent transfer layer and/or the transferable protective layer together with the transferable scratch layer such that the transferable scratch layer, the coloring agent transfer layer and/or the transferable protective layer are alternately provided side by side. At least one of the step of recording information with the coloring agent transfer layer and the step of coating the information record section with the transferable protective layer and the step of transferring the scratch layer are carried out using the same thermal transfer sheet whereby a heating means such as a thermal head is used as a heating means common to these transfer steps and also, it is not required to exchange the thermal transfer sheet every transfer step, making it possible to simplify the control of the conveyance and switching of the thermal transfer sheet.

For example, in the case of using the scratch layer transfer sheet in which the coloring agent transfer layer and the transferable scratch layer are alternately provided side by side on one surface of the substrate film, first the coloring agent transfer layer of the scratch layer transfer sheet is allowed to face and overlap on the print surface of the transfer-receiving material to record information including characters and images by heating using a heating means such as a thermal head or a laser. By this step, information is recorded on the print surface of the transfer-receiving material. Then, the transferable scratch layer of the scratch layer transfer sheet is allowed to face and overlap on the print surface of the transfer-receiving material on which the information is recorded in advance, followed by heating to transfer the scratch layer thereby obtaining a scratch print product.

Also, in the case of using the scratch layer transfer sheet in which the transferable protective layer and the transferable scratch layer are alternately provided side by side on one surface of the substrate film, first a transfer-receiving material provided with a print surface on which information is recorded in advance is prepared and the transferable protective layer of the scratch layer transfer sheet is allowed to face and overlap on the print surface of the transfer-receiving material, followed by heating using a heating means such as a thermal head or a laser to transfer the protective layer. Next, the transferable scratch layer of the scratch layer transfer sheet is allowed to face and overlap on the print surface of the transfer-receiving material coated with the protective layer, followed by heating to transfer the scratch layer, thereby obtaining a scratch print product.

In the case of using the scratch layer transfer sheet in which the coloring agent transfer layer, the transferable protective layer and the transferable scratch layer are alternately provided side by side on one surface of the substrate film, first the coloring agent transfer layer of the scratch layer transfer sheet is allowed to face and overlap on the print surface of the transfer-receiving material to record information including characters and images by a heating means such as a thermal head or a laser. Next, the transferable protective layer of the scratch layer transfer sheet is allowed to face and overlap on the information-recorded print surface of the transfer-receiving material, followed by heating using a heating means such as a thermal head or a laser to transfer the protective layer. Then, the transferable scratch layer of the scratch layer transfer sheet is allowed to face and overlap on the print surface coated with the protective layer, followed by heating to transfer the scratch layer thereby obtaining a scratch print product.

It is to be noted that the method of the production of a scratch print product according to the present invention may be applied to both a line printer system in which a thermal transfer sheet and a transfer-receiving material are conveyed in the same direction to record and a serial printer system in which the direction in which the thermal transfer sheet is conveyed is made perpendicular to the direction in which the transfer-receiving material is conveyed, in the case of using a thermal head as a heating means.

As mentioned above, the method of producing a scratch print product according to the present invention and the scratch layer transfer sheet used in this method ensures that the information recorded on the transfer-receiving material such as a card and ticket can be coated and hidden simply with the scratch layer by a thermal transfer method. Also, the scratch layer applied to the print surface of the transfer-receiving material can be easily scratched by a nail or a coin.

Also, when the scratch layer transfer sheet of the present invention is provided with a transferable scratch layer in which a transferable pattern layer formed pattern-wise and a hiding layer containing an aluminum pigment and a thermoplastic resin are laminated in order and the scratch layer is thermally transferred to the information section recorded on a transfer-receiving material such as a card by using the scratch layer transfer sheet, the recorded information can be coated with the scratch layer in which two layers, namely the hiding layer and the pattern layer are both present. Therefore, the surface glossiness and the hue are changed and the recorded information having a rise cannot be read. Further, the hiding layer comprising the aforementioned components has sufficient hiding ability and moderate cohesive force and can therefore be scraped off easily.

Also, according to the present invention, the protective layer is thermally transferred to the information recorded on a transfer-receiving material such as a card and a ticket by using the protective layer transfer sheet and then the scratch layer which can hide the recorded information of the transfer-receiving material and removable from the transfer-receiving material is thermally transferred on the protective layer by using the scratch layer transfer sheet, thus the protective layer and the scratch layer can be laminated in order on the information record section of the transfer-receiving material. In this case, the protective layer functions as a filler to level the rise of the information record section and the irregularities of the substrate of the transfer-receiving material. The scratch layer, in turn, produces a sufficient hiding effect so that the information recorded on the transfer-receiving material is made indistinguishable as it is and can be easily scraped off by a nail or coin.

Further, the scratch transfer sheet of the present invention comprises one or both of the coloring agent transfer layer which can optionally record characters and information and the transferable protective layer which protects the print surface together with the transferable scratch layer on one surface of the substrate film such that these layers are alternately applied separately side by side. This structure serves to omit the troublesome work for exchanging the thermal transfer sheet and also the coloring agent layer, the protective layer and the scratch layer can be transferred by using only one thermal transfer sheet when one scratch print product is prepared.

Also, the recording method of the present invention ensures that the step of recording on both the part to be hidden and the part to be unhidden on the surface of the transfer-receiving material and the step of hiding a part or all of the recorded information can be carried out continuously because the thermal transfer sheet in which the above coloring agent layer transfer layer and the transferable scratch layer are alternately applied separately side by side on the same substrate is used.

EXAMPLE

The present invention will be explained in more detail by way of examples, wherein all designations of parts and % are weight basis, unless otherwise noted.

Example A Series

Example A-1

Using a 6 μm-thick PET with one surface being treated for easy adhesion as a substrate film, a heat resistant layer having a coating thickness of 1 μm in dry state was formed in advance on the other surface of the substrate film. A coating solution having the following composition for a hiding layer was applied in a solid pattern on the entire surface (which was treated for easy adhesion) of the substrate film by hotmelt coating and dried to form a transferable scratch layer in a coating thickness of 6.0 g/m$^2$ in dry state, thereby preparing a thermal transfer sheet of Example A-1.

| <Coating solution for hiding layer> | |
|---|---|
| Aluminum paste | 20 parts |
| Carbon black | 5 parts |
| Ethylene/vinyl acetate copolymer resin | 15 parts |
| Micro wax | 65 parts |

Example A-2

Using a 6 μm-thick PET with one surface being treated for easy adhesion as a substrate film, a heat resistant layer having a coating thickness of 1 μm in dry state was formed in advance on the other surface of the substrate film. A coating solution having the following composition for a pattern layer was applied with a diced pattern on the entire surface (which was treated for easy adhesion) of the substrate film by using a gravure printing machine and dried to form a pattern layer in a coating thickness of 0.5 g/m$^2$ in dry state. Further, the coating solution used in Example 1 for a hiding layer was applied in a solid pattern on the entire surface of the pattern layer and the substrate film by hotmelt coating and dried to form a transferable scratch layer in a coating thickness of 6.0 g/m$^2$ in dry state, thereby preparing a thermal transfer sheet of Example A-2.

| <Coating solution for pattern layer> | |
|---|---|
| Carbon black-water dispersion (solid content: 30%) | 20 parts |
| Carnauba wax emulsion (solid content: 40%, melting point: 82° C.) | 20 parts |
| Water/isopropyl alcohol (ratio by weight: 1/2) | 60 parts |

Example A-3

In the same manner as in the case of the above thermal transfer sheet of Example A-2, the coating solution used in Example A-2 for a pattern layer was applied with a diced pattern on the other surface (which was treated for easy adhesion) of the substrate film, on which the heat resistant layer was formed in advance, by using a gravure printing machine and dried to form a pattern layer in a coating thickness of 0.5 g/m$^2$ in dry state. Then, a coating solution having the following composition for a peeling layer was applied in a solid pattern on the entire surface of the pattern layer and substrate film by gravure coating and dried to form a peeling layer having a coating thickness of 0.5 g/m$^2$ in dry state. Further, the coating solution having the following composition for a hiding layer was applied in a solid pattern on the entire surface of the peeling layer by gravure coating using a solvent type ink and dried to form a hiding layer in a coating thickness of 3.0 g/m$^2$ in dry state, thereby preparing a thermal transfer sheet of Example A-3.

| <Coating solution for peeling layer> | |
|---|---|
| Polyolefin chloride resin | 30 parts |
| Toluene | 70 parts |

| <Coating solution for hiding layer> | |
|---|---|
| Aluminum paste | 15 parts |
| Ethylene/vinyl acetate copolymer resin | 30 parts |
| Toluene/methyl ethyl ketone (ratio by weight: 5:1) | 70 parts |

Example A-4

In the same manner as in the case of the above thermal transfer sheet of Example A-2, the coating solution used in Example A-2 for a pattern layer was applied with a diced pattern on the other surface (which was treated for easy adhesion) of the substrate film, on which the heat resistant layer was formed in advance, by using a gravure printing machine and dried to form a pattern layer in a coating thickness of 0.5 g/m$^2$ in dry state. Then, the coating solution used in Example A-3 for a peeling layer was applied in a solid pattern on the entire surface of the pattern layer and substrate film by gravure coating and dried to form a peeling layer having a coating thickness of 1.0 g/m$^2$ in dry state. Further, a coating solution having the following composition for a hiding layer was applied in a solid pattern on the entire surface of the peeling layer by gravure coating using a solvent type ink and dried to form a hiding layer in a coating thickness of 3.0 g/m$^2$ in dry state. Furthermore, a coating solution having the following composition for an adhesive layer was applied in a solid pattern on the entire surface of the hiding layer by gravure coating and dried to form an adhesive layer in a coating thickness of 2.0 g/m$^2$ in dry state, thereby preparing a thermal transfer sheet of Example A-4.

| <Coating solution for hiding layer> | |
|---|---|
| Aluminum paste | 15 parts |
| Polyester resin | 10 parts |
| Toluene/methyl ethyl ketone (ratio by weight: 5:1) | 75 parts |

| <Coating solution for adhesive layer> | |
|---|---|
| Ethylene/vinyl acetate copolymer resin emulsion (solid content: 35%) | 20 parts |
| Water/isopropyl alcohol (ratio by weight: 1/2) | 80 parts |

Example A-5

A thermal transfer sheet of Example A-5 was prepared in the same manner as in Example A-3 except that first the coating solution used in Example A-3 for a peeling layer was applied to the surface (which was treated for easy adhesion) of the substrate film used in the above Example A-3 and dried to form a peeling layer having a coating thickness of 0.5 g/m$^2$ in dry state and further a coating solution having the following composition for a pattern layer was applied with a diced pattern to the peeling layer to form a pattern layer in a thickness of 0.5 g/m$^2$ in dry state.

| <Coating solution for pattern layer> | |
|---|---|
| Carbon black-water dispersion (solid content: 30%) | 20 parts |
| Polyester resin emulsion (solid content: 25%, Tg: 60° C., number average molecular weight: 15000) | 20 parts |
| Water/isopropyl alcohol (ratio by weight: 1/2) | 60 parts |

Example A-6

A thermal transfer sheet of Example A-6 was produced in the same manner as in Example A-4 except that the coating solution for an adhesive layer of the above thermal transfer sheet produced in Example A-4 was altered to a coating solution having the following composition.

| <Coating solution for adhesive layer> | |
|---|---|
| Ethylene/acrylic acid copolymer resin emulsion (solid content: 30%, Tg: 20° C.) | 20 parts |
| Carnauba wax emulsion (solid content: 40%, Melting point: 82° C.) | 5 parts |
| Water/isopropyl alcohol (ratio by weight: 1/2) | 75 parts |

Example A-7

A thermal transfer sheet of Example A-7 was produced in the same manner as in Example A-3 except that the pattern of the pattern layer of the above thermal transfer sheet produced in Example A-3 was altered to a logo shown in FIG. 23.

Example A-8

A thermal transfer sheet of Example A-8 was produced in the same manner as in Example A-3 except that the coating solution for a pattern layer of the above thermal transfer sheet produced in Example A-3 was altered to a coating solution having the following composition and the coating thickness was altered to 1.0 g/m$^2$ in dry state.

| <Coating solution for pattern layer> | |
|---|---|
| Carbon black-water dispersion (solid content: 30%) | 10 parts |
| Polyester resin emulsion (solid content: 25%, Tg: −5° C., number average molecular weight: 20000) | 20 parts |
| Methyl ethyl ketone (ratio by weight: 1/1) | 70 parts |

(Method of Evaluation of Examples A-1 to A-8)

Variable information such as black characters and numerals were recorded in advance on a vinyl chloride card by using a commercially available bar code thermal transfer ribbon. Next, using the scratch layer transfer sheet prepared in each of the above Examples, thermal transfer was conducted by a thermal head at a print energy of 0.4 mJ/dot (higher than usual print energy) so as to cover the record section of the above variable information and so as to form a hiding part slightly larger than the whole surface of the variable information record section.

Example A-9

Variable information such as black characters and numerals were recorded on a vinyl chloride card as a transfer-receiving material. Using the cards with a record section having a center plane average roughness SPas of 1.0 μm, 5.0 μm and 11.0 μm in the measurement of three-dimensional roughness and the above thermal transfer sheet of Example A-3, a hiding part slightly larger than the entire surface of the variable information record section was formed so as to cover the variable information record section. The heating and transfer conditions of the hiding part are the same as above.

(Result of Evaluation)

In the case of using the thermal transfer sheets of Examples A-2 to A-8, a difference in glossiness was observed as a pattern on the surface of the hiding part placed on the record section of the variable information including characters and numerals, the irregularities of the variable information record section was indistinguishable even if the card was viewed from an oblique direction and also, the variable information record section was indistinguishable due to the hiding ability of the hiding layer and the black pattern of the pattern layer even if it was intended to see through the record section, showing that these transfer sheets had excellent hiding ability. In the case of using the thermal transfer sheet of Example A-1, the variable information record section was indistinguishable when viewed from the front side although there was no pattern of the pattern layer on the surface of the hiding part above the variable information record section, showing that the transfer sheet of Example A-1 had almost high hiding ability.

Also, the thermally transferred hiding part in Examples A-1 to A-8 could be easily scraped off by scratching using a nail. To state concretely, the pencil scratch value of the scratch layer (hiding part) transferred to the transfer-receiving material was HB or lower in terms of the pencil scratch value prescribed in the hand-writing-method of JIS K 5400. In short, the above pencil scratching value was HB or lower, namely the pencil scratching value was any one of HB, B, 2B, 3B, 4B, 5B and 6B. In the case where the pencil scratch value is, for example, HB, the hiding part of the coating film is broken if it is scratched using a pencil having a pencil scratch value ranging between 9H and HB. On the contrary, the hiding part is not broken even if it is scratched using a pencil having a pencil scratch value ranging between B and 6B. In the case where the pencil scratch value is 6B, the hiding part of the coating film is broken if it is scratched using a pencil having a pencil scratch value ranging between 9H and 6B.

When the hiding part of the coating film is broken by the above pencil scratching, the underlying variable information record part emerges clearly. It is to be noted that the hiding part formed by thermal transfer was never peeled off during handling of the card (it was held in a pass holder and carried).

As to Example A-9, in the case of the thermal transfer sheets in which the center plane average roughness SPa of the part printed in advance on the transfer-receiving material in the measurement of three-dimensional roughness was 1.0 μm or 5.0 μm, a difference in glossiness was observed as a pattern on the surface of the hiding part placed on the record section of the variable information, the irregularities of the variable information record section was indistinguishable even if the card was viewed from an oblique direction and also, the variable information record section was indistinguishable due to the hiding ability of the hiding layer and the black pattern of the pattern layer even if it was intended to see through the record section, showing that these transfer sheets had excellent hiding ability. On the other hand, in the case of the thermal transfer sheets in which the center plane average roughness SPa of the part printed in advance on the transfer-receiving material in the measurement of three-dimensional roughness was 11.0 μm, the thermally transferred hiding part could be easily scraped off and the underlying variable information record section emerges clearly. However, the irregularities of the variable information record section was distinguishable when the card was viewed from an oblique direction.

Example B Series

Example B-1

A heat resistant layer was formed in advance on one surface of a 4.5 μm-thick polyethylene terephthalate film (Lumirror, manufactured by Toray) used as a substrate film in a coating thickness of 0.5 g/m$^2$ in dry state. A coating solution having the following composition for a heat meltable ink layer was applied with a repeated intermittent pattern as shown in FIG. 6 on the substrate film surface opposite to the surface, on which the heat resistant layer was formed, by hotmelt coating and dried to form a heat meltable ink layer in a coating thickness of 2.0 g/m$^2$ in dry state. Further, a coating solution having the following composition for a hiding layer was applied with a repeated intermittent pattern (in a apace where the above heat meltable ink layer was not applied) as shown in FIG. 6 on the substrate film surface opposite to the surface, on which the heat resistant layer was formed, by hotmelt coating and dried to form a transferable scratch layer in a coating thickness of 2.0 g/m$^2$ in dry state, thereby preparing a thermal transfer sheet of Example B-1.

| <Coating solution for heat meltable ink layer> | |
|---|---|
| Carbon black | 32.5 parts |
| Carnauba wax | 25 parts |
| Paraffin wax | 25 parts |
| Ethylene/vinyl acetate copolymer | 17.5 parts |

| <Coating solution for hiding layer> | |
|---|---|
| Aluminum paste | 20 parts |
| Carbon black | 5 parts |
| Ethylene/vinyl acetate copolymer resin | 15 parts |
| Micro wax | 65 parts |

Example B-2

In the same manner as in the preparation of the above transfer sheet of Example B-1, a heat resistant layer was formed in advance on one surface of a 4.5 μm-thick polyethylene terephthalate film (Lumirror, manufactured by Toray) substrate in a coating thickness of 0.5 g/m$^2$ in dry state. Then, a coating solution having the following composition for a peeling layer was applied in a solid pattern on the entire of the substrate film surface opposite to the surface, on which the heat resistant layer was formed, by gravure coating to form a peeling layer in a thickness of 0.5 g/m$^2$ in dry state. Further, the coating solution used in Example B-1 for a heat meltable ink layer was applied with a repeated intermittent pattern on the peeling layer in the same manner as in Example B-1 and dried to form a heat meltable ink layer in a coating thickness of 2.0 g/m$^2$ in dry state. Further, the coating solution used in Example B-1 for a hiding layer was applied with a repeated intermittent pattern (in a apace where the above heat meltable ink layer was not applied) on the heat meltable ink layer and dried to form a transferable scratch layer in a coating thickness of 2.0 g/m$^2$ in dry state, thereby preparing a thermal transfer sheet of Example B-2.

| <Coating solution for peeling layer> | |
|---|---|
| Polyolefin chloride resin | 30 parts |
| Toluene | 70 parts |

Example B-3

In the same manner as in the preparation of the above transfer sheet of Example B-1, a heat resistant layer was formed in advance on one surface of a 4.5 μm-thick polyethylene terephthalate film (Lumirror, manufactured by Toray) substrate in a coating thickness of 0.5 g/m$^2$ in dry state. Then, the coating solution used in Example B-2 for a peeling layer was applied in a solid pattern on the entire of the substrate film surface opposite to the surface, on which the heat resistant layer was formed, in the same manner as in Example B-2 to form a peeling layer in a thickness of 0.5 g/m$^2$ in dry state. Further, a coating solution having the following composition for a heat meltable ink layer was applied with a repeated intermittent pattern on the peeling layer by gravure printing in the same manner as in Example B-1 and dried to form a heat meltable ink layer in a coating thickness of 1.0 g/m$^2$ in dry state.

Then, a coating solution having the following composition for a pattern layer was applied with a picture pattern shown in FIG. 18(1) to the part where the above heat meltable ink layer was not applied (space between the parts where the heat meltable ink layer was formed) by gravure printing and dried to form a pattern layer in a coating thickness of 0.3 g/m$^2$. Further, a coating solution having the following composition for a hiding layer was formed with a repeated intermittent solid pattern as shown in FIG. 6 on the pattern layer by gravure printing to form a hiding layer in a coating thickness of 2.0 g/m$^2$. Also, a coating solution having the following composition for an adhesive layer was applied with a solid pattern to the hiding layer and dried to form an adhesive layer in a coating thickness of 2.0 g/m$^2$ in dry state, thereby preparing a thermal transfer sheet of Example B-3.

| <Coating solution for heat meltable ink layer> | |
|---|---|
| Carbon black | 10 parts |
| Acrylic resin (BR-87, manufactured by Mitsubishi Rayon) | 10 parts |
| Methyl ethyl ketone | 40 parts |
| Toluene | 40 parts |

| <Coating solution for pattern layer> | |
|---|---|
| Carbon black-water dispersion (solid content: 30%) | 10 parts |
| Styrene-acryl copolymer resin emulsion (Tg: 20° C., solid content: 30%) | 10 parts |
| Isopropyl alcohol | 50 parts |
| Water | 30 parts |

| <Coating solution for hiding layer> | |
|---|---|
| Aluminum paste | 20 parts |
| Vinyl chloride/vinyl acetate copolymer resin (degree of polymerization: 200, Tg: 75° C.) | 20 parts |
| Methyl ethyl ketone | 30 parts |
| Toluene | 30 parts |

| <Coating solution for adhesive layer> | |
|---|---|
| Ethylene/vinyl acetate copolymer resin emulsion (MFT: 70° C., solid content: 40%, average particle diameter: 7 μm) | 30 parts |
| Isopropyl alcohol | 50 parts |
| Water | 20 parts |

Example B-4

A thermal transfer sheet of Example B-4 was produced in the same manner as in Example B-3 except that carbon black used in the coating solution for a heat meltable ink layer in the thermal transfer sheet of Example B-3 was altered to Pigment Blue 15:4.

Example B-5

A thermal transfer sheet of Example B-5 was produced in the same manner as in Example B-3 except that carbon black used in the coating solution for a heat meltable ink layer in the thermal transfer sheet of Example B-3 was altered to Pigment Red 48:3.

Example B-6

A thermal transfer sheet of Example B-6 was produced in the same manner as in Example B-3 except that the picture pattern of the pattern layer in the thermal transfer sheet of Example B-3 was altered to the pattern shown in FIG. 23.

Example B-7

A thermal transfer sheet of Example B-7 was produced in the same manner as in Example B-3 except that the area of one partition coated with the transferable scratch layer on which the pattern layer, the hiding layer and the adhesive layer are laminated in the thermal transfer sheet of Example B-3 was altered to 50% of the maximum area of the print surface of the transfer-receiving material.

Example B-8

A thermal transfer sheet of Example B-8 was produced in the same manner as in Example B-3 except that the area of one partition coated with the transferable scratch layer on which the pattern layer, the hiding layer and the adhesive layer are laminated in the thermal transfer sheet of Example B-3 was altered to 140% of the maximum area of the print surface of the transfer-receiving material.

Reference Example b-1

A thermal transfer sheet of Reference Example 1 was produced in the same manner as in Example B-1 except that the thickness of the heat meltable ink layer was altered to 10.0 g/m$^2$ in terms of coating thickness in dry state in the thermal transfer sheet of Example B-1.

(Method of Evaluation of Example B Series)

Using the thermal transfer sheets prepared in the above Examples and Reference Example, a bold-faced character "B" with a size of 6 point according to a style of type, Times New Roman was recorded repeatedly on a transfer-receiving material, that is, a card made of a poly vinyl chloride resin by heating and transferring the heat meltable ink layer by using a thermal head at a print energy of 0.3 mJ/dot.

Next, in Examples and the Reference Example, using the same thermal transfer sheet that was used to transfer the above thermal transfer ink layer, the transferable scratch layer was heated and transferred using a thermal head at a print energy of 0.4 mJ/dot so as to cover the aforementioned record section and so as to form a hiding part slightly larger than the whole surface of the record section without exchanging the thermal transfer sheet.

The above transfer receiving materials on which the character was printed were subjected to tests to evaluate the hiding ability of the record section, to measure the center plane average roughness SPa of the information section recorded on the transfer-receiving material by the measurement of three-dimensional roughness and to measure the pencil scratching value of the scratch layer after the scratch layer was transferred.

<Hiding Ability of the Record Section>

The sample prepared by transferring the scratch layer as the hiding part to the information section recorded on the transfer-receiving material in the above condition was seen through visually or viewed from an oblique direction to examine the ability to hide the record section. Evaluation was made according to the following standard.

○: the recorded information is indistinguishable and therefore the sample has high hiding ability.

X: when the recorded information is viewed from an oblique direction, the information is distinguishable by the irregularities of the surface, showing that the sample has poor hiding ability.

<Center plane Average-Roughness SPa>

A Surfcom 570A-3DF manufactured by Tokyo Seimitsu as a three-dimensional roughness shape measuring meter was used to measure the center plane average roughness SPa. The area for measurement was 1.5 cm×1.5 cm and a bold-faced character "B" with a size of 6 point according to a style of type, Times New Roman was recorded on a PVC (poly vinyl chloride resin) card to measure the center plane average roughness SPa of B. The recorded section as the position to be measured was the section which was thermally transferred to the PVC card from the thermal transfer sheet.

<Pencil Scratching Value>

Using a sample obtained by transferring the scratch layer as the hiding part to the section of the information recorded on the transfer-receiving material in the above condition, the pencil scratching value of the scratch layer was measured by a method prescribed in the handwriting method of JIS K 5400.

(Results of Evaluation of Example B Series)

The results of evaluation are shown in Table 1.

TABLE 1

| | Hiding ability of record section | Center plane average value of three-dimensional roughness | Pencil Scratching value |
|---|---|---|---|
| Example B-1 | ○ | 4.3 μm | 6B |
| Example B-2 | ○ | 7.5 μm | 6B |
| Example B-3 | ○ | 2.3 μm | 5B |
| Example B-4 | ○ | 2.3 μm | 5B |
| Example B-5 | ○ | 2.3 μm | 5B |
| Example B-6 | ○ | 2.3 μm | 5B |
| Example B-7 | ○ | 2.3 μm | 5B |
| Example B-8 | ○ | 2.3 μm | 5B |
| Reference Example b-1 | X | 12.1 μm | 6B |

Example C Series

Example C-1

Using a 4.5 μm-thick PET with one surface being treated for easy adhesion as a substrate film, a heat resistant layer having a coating thickness of 0.3 g/m$^2$ in dry state was formed in advance on the other surface of the substrate film by using a coating solution having the following composition. A coating solution having the following composition for a peeling layer was formed on the surface (which was treated for easy adhesion) of the substrate film by gravure coating as shown in FIG. 24 and dried to form a peeling layer in a coating thickness of 0.5 g/m$^2$ in dry state. A coating solution having the following composition for a heat meltable layer was applied to the peeling layer by gravure coating and dried to form a heat meltable ink layer 9*a* in a coating thickness of 0.8 g/m$^2$ in dry state.

| <Coating solution for heat resistant layer> | |
|---|---|
| Silicone resin | 10 parts |
| Methyl ethyl ketone/toluene (ratio by weight: 10/1) | 90 parts |

| <Coating solution for peeling layer> | |
|---|---|
| Acrylic resin | 25 parts |
| Methyl ethyl ketone/toluene (ratio by weight: 1/1) | 75 parts |

| <Coating solution for heat meltable ink layer> | |
|---|---|
| Carbon black | 10 parts |
| Acrylic resin | 10 parts |
| Polyester resin | 10 parts |
| Methyl ethyl ketone/toluene (ratio by weight: 1/1) | 70 parts |

Also, as shown in FIG. 24, in a coating solution having the following composition for a protective layer was applied alternately side by side with the heat meltable ink layer formed on the surface (which was treated for easy adhesion) of the above substrate film by using a gravure printing machine and dried to form a main protective layer in a coating thickness of 1.0 g/m$^2$ in dry state. Then, a coating solution having the following composition for an adhesive layer was applied to the main protective layer by using a gravure printing machine and dried to form an adhesive layer in a coating thickness of 1.0 g/m$^2$ in dry state. This is the case of providing a transferable protective layer 10 comprising the main protective layer and the adhesive layer.

| <Coating solution for protective layer> | |
|---|---|
| Acrylic resin | 25 parts |
| Methyl ethyl ketone/toluene (ratio by weight: 1/1) | 75 parts |

| <Coating solution for adhesive layer> | |
|---|---|
| Carnauba wax | 15 parts |
| Polyester resin | 15 parts |
| Water/isopropyl alcohol (ratio by weight: 1/2) | 70 parts |

Further, a coating solution having the following composition for a peeling layer was applied alternately side by side with the heat meltable ink layer and protective layer formed on the surface (which was treated for easy adhesion) of the above substrate film by using a gravure printing machine as shown in FIG. 24 and dried to form a peeling layer in a coating thickness of 0.5 g/m$^2$ in dry state. Further, a coating solution having the following composition for a pattern layer was applied with a diced pattern to the peeling layer by using a gravure printing machine and dried to form a pattern layer 4 in a thickness of 0.4 g/m$^2$ in dry state. Moreover, a coating solution having the following composition for a hiding layer was applied in a solid pattern to the pattern layer by using a gravure printing machine and dried to form a hiding layer 3 in a thickness of 3.0 g/m$^2$ in dry state. Also, a coating solution having the following composition for an adhesive layer was applied to the hiding layer by using a gravure printing machine and dried to form a adhesive layer in a thickness of 0.5 g/m$^2$ in dry state, thereby preparing a thermal transfer sheet of Example C-1. This is the case of providing a transferable scratch layer 2 comprising the peeling layer, the pattern layer, the hiding layer and the adhesive layer.

| <Coating solution for peeling layer> | |
|---|---|
| Polyolefin chloride | 25 parts |
| Methyl ethyl ketone/toluene (ratio by weight: 1/1) | 75 parts |

| <Coating solution for pattern layer> | |
|---|---|
| Carbon black | 15 parts |
| Polyester resin | 15 parts |
| Water/isopropyl alcohol (ratio by weight: 1/1) | 70 parts |

| <Coating solution for hiding layer> | |
|---|---|
| Aluminum pigment | 15 parts |
| Acrylic resin | 15 parts |
| Methyl ethyl ketone/toluene (ratio by weight: 1/1) | 70 parts |

| <Coating solution for adhesive layer> | |
|---|---|
| Ethylene/vinyl acetate copolymer | 25 parts |
| Water/isopropyl alcohol (ratio by weight: 1/1) | 75 parts |

Example C-2

In the above thermal transfer sheet of Example C-1, the structure: substrate film/peeling layer/pattern layer/hiding layer/adhesive layer, of the transfer scratch layer was altered to a structure: substrate film/pattern layer/hiding layer. Specifically, a coating solution having the following composition for a pattern layer was applied with a diced pattern to the substrate film (treated for easy adhesion and provided with a heat resistant layer) used in Example C-1 by using a gravure printing machine and dried to form a pattern layer in a thickness of 0.4 g/m$^2$ in dry state. Then, a coating solution having the following composition for a hiding layer was applied to the pattern layer by hotmelt coating and dried to form a hiding layer in a thickness of 5.0 g/m$^2$ in dry state. The same procedures as in Example C-1 were conducted except for the above process to form a thermal transfer sheet of Example C-2.

| <Coating solution for pattern layer> | |
|---|---|
| Carbon black | 15 parts |
| Polyolefin chloride | 15 parts |
| Methyl ethyl ketone/toluene (ratio by weight: 1/1) | 70 parts |

| <Coating solution for hiding layer> | |
|---|---|
| Aluminum pigment | 20 parts |
| Ethylene/vinyl acetate copolymer | 40 parts |
| Microcrystalline wax | 40 parts |

Example C-3

In the above thermal transfer sheet of Example C-1, the structure: substrate film/peeling layer/pattern layer/hiding layer/adhesive layer, of the transfer scratch layer was altered to a structure: substrate film/peeling layer/pattern layer/hiding layer. Specifically, a coating solution having the following composition for a peeling layer was applied with a diced pattern to the substrate film (treated for easy adhesion and provided with a heat resistant layer) used in Example C-1 by using a gravure printing machine and dried to form a peeling layer in a thickness of 0.5 g/m$^2$ in dry state. A coating solution having the following composition for a pattern layer was applied with a diced pattern to the peeling layer by using a gravure printing machine and dried to form a pattern layer in a thickness of 0.4 g/m$^2$ in dry state. Then, a coating solution having the following composition for a hiding layer was applied to the pattern layer by hotmelt coating and dried to form a hiding layer in a thickness of 5.0 g/m$^2$ in dry state. The same procedures as in Example C-1 were conducted except for the above process to form a thermal transfer sheet of Example C-3.

| <Coating solution for peeling layer> | |
|---|---|
| Polyolefin chloride | 25 parts |
| Methyl ethyl ketone/toluene (ratio by weight: 1/1) | 75 parts |

| <Coating solution for pattern layer> | |
|---|---|
| Carbon black | 15 parts |
| Polyester resin | 15 parts |
| Water/isopropyl alcohol (ratio by weight: 1/1) | 70 parts |

| <Coating solution for hiding layer> | |
|---|---|
| Aluminum pigment | 20 parts |
| Ethylene/vinyl acetate copolymer | 40 parts |
| Microcrystalline wax | 40 parts |

Example C-4

In the above thermal transfer sheet of Example C-1, the structure: substrate film/main protective layer/adhesive layer, of the transferable protective layer was altered to a structure: substrate film/main protective layer. Specifically, a coating solution having the following composition for a protective layer was applied to the substrate film (treated for easy adhesion and provided with a heat resistant layer) used in Example C-1 by using a gravure printing machine and dried to form a main protective layer in a thickness of 1.0 g/m$^2$ in dry state. The same procedures as in Example C-1 were conducted except for the above process to form a thermal transfer sheet of Example C-4.

| <Coating solution for protective layer> | |
|---|---|
| Carnauba wax | 10 parts |
| Styrene/acryl copolymer | 15 parts |
| Polyester resin | 5 parts |
| Water/isopropyl alcohol (ratio by weight: 1/2) | 70 parts |

(Method of Evaluation of Examples C-1 to C-4)

First, variable information such as characters and numerals were recorded in advance on transfer receiving materials of a vinyl chloride card and a coated paper by using the thermal transfer sheet prepared in the above examples. Next, using the thermal transfer sheet prepared in the example, the protective layer was thermally transferred so as to cover the record section of the above variable information and so as to form a hiding part slightly larger than the whole surface of the variable information record section and further, the scratch layer was thermally transferred to the protective layer by using a thermal head.

Example C-5

Variable information such as characters and numerals were recorded on a vinyl chloride card and a coated paper as transfer-receiving materials by using the thermal transfer sheet prepared in Example C-3. The film thickness of the ink layer was controlled such that the center plane average roughness SPa of the record section in the measurement of three-dimensional roughness were 1.0 μm, 5.0 μm and 11.0 μm. Then, using the above thermal transfer sheet of Example C-3, the protective layer and the scratch layer were thermally transferred so as to cover the variable information record section and so as to form a hiding part slightly larger than the whole surface of the variable information record section.

(Result of Evaluation of Example C Series)

With regard to the print products obtained in Examples C-1 to C-4 in the above manner, a difference in glossiness as a pattern was observed on the surface of the hiding part placed on the record section of the variable information including characters and numerals, the irregularities of the variable information record section was indistinguishable even if the card was viewed from an oblique direction and also, the variable information record section was indistinguishable due to the hiding ability of the hiding layer and the black pattern of the pattern layer even if it was intended to see through the record section, showing that these transfer sheets had excellent hiding ability.

Also, the thermally transferred hiding part in Examples C-1 to C-4 could be easily scraped off by scratching using a nail. To state concretely, the pencil scratch value of the scratch layer (hiding part) transferred to the transfer-receiving material was HB or lower in terms of the pencil scratch value prescribed in the hand-writing method of JIS K 5400. In short, the above pencil scratching value was HB or lower, namely the pencil scratching value was any one of HB, B, 2B, 3B, 4B, 5B and 6B. In the case where the pencil scratch value is, for example, HB, the hiding part of the coating film is broken if it is scratched using a pencil having a pencil scratch value ranging between 9H and HB. On the contrary, the hiding part is not broken even if it is scratched using a pencil having a pencil scratch value ranging between B and 6B. In the case where the pencil scratch value is 6B, the hiding part of the coating film is broken if it is scratched using a pencil having a pencil scratch value ranging between 9H and 6B.

When the hiding part of the coating film is broken by the above pencil scratching, the underlying variable information record part emerges clearly. It is to be noted that the thermally transferred hiding part was never peeled off during handling of the card (it was held in a pass holder and carried).

As to Example C-5, in the case of the thermal transfer sheets in which the center plane average roughness SPa of the part printed in advance on the transfer-receiving material in the measurement of three-dimensional roughness was 1.0 μm or 5.0 μm, a difference in glossiness was observed as a pattern on the surface of the hiding part placed on the record section of the variable information, the irregularities of the variable information record section was indistinguishable even if the card was viewed from an oblique direction and also, the variable information record section was indistinguishable due to the hiding ability of the hiding layer and the black pattern of the pattern layer even if it was intended to see through the record section, showing that these transfer sheets had excellent hiding ability.

On the other hand, in the case of the thermal transfer sheets in which the center plane average roughness SPa of the part printed in advance on the transfer-receiving material in the measurement of three-dimensional roughness was 11.0 μm, the thermally transferred hiding part could be easily scraped off and the underlying variable information record section emerges clearly. However, as to the hiding ability, the irregularities of the variable information record section was distinguishable when the card was viewed from an oblique direction.

What is claimed is:

1. A method of producing a scratch print product comprising the steps of:

providing a transfer-receiving material provided with a print surface on which information is recorded in advance;

providing a scratch layer transfer sheet comprising a substrate film, a transferable scratch layer and a transferable protective layer disposed alternatively side by side on one surface of the substrate film, said transferable scratch layer having a multilayer structure disposed on the surface of the substrate film and comprising a pattern layer, which is formed pattern-wise on selected portions of the substrate surface, and a hiding layer, which is formed on portions of the pattern layer and on the substrate surface not covered by the pattern layer, wherein the pattern layer and the hiding layer are transferable to the print surface of the transfer-receiving material and removable from said print surface by scratching after the transferable scratch layer is transferred, and wherein said transferable protective layer has a monolayer or multilayer structure provided with a main protective layer protecting the print surface;

overlapping the scratch layer transfer sheet on the transfer-receiving material such that the transferable protective layer of the scratch layer transfer sheet faces the print surface of the transfer-receiving material to transfer said transferable protective layer to the print surface by heating; and overlapping the transferable scratch layer of said scratch layer transfer sheet on the print surface of said transfer-receiving material such that the transferable scratch layer faces the print surface to transfer said transferable scratch layer to the print surface by heating, wherein, when the areas respectively occupied by said pattern layer and said hiding layer are compared with each other, the proportion of the area occupied by the pattern layer (pattern ratio) is in a range from 5 to 85% per 2 $cm^2$ of the transferred scratch layer.

2. The method of producing a scratch print product according to claim 1, wherein said hiding layer comprises at least a hiding material and a binder.

3. The method of producing a scratch print product according to claim 2, wherein said hiding layer is formed of a heat meltable ink comprising an aluminum pigment, a carbon black, a wax and an ethylene/vinyl acetate copolymer resin as essential components.

4. The method of producing a scratch print product according to claim 1, wherein said print surface on which information is recorded in advance has a center plane average roughness SPa of 10 μm or less in the measurement of three-dimensional roughness.

5. The method of producing a scratch print product according to claim 1, wherein the area of one partition of the transferable scratch layer of said scratch layer transfer sheet is in a range from 30 to 150% based on the maximum area of the print surface of the transfer-receiving material to which the transferable scratch layer is to be transferred.

6. The method of producing a scratch print product according to claim 1, wherein said transferable scratch layer after being transferred to the transfer-receiving material has a level of HB or less as the pencil scratch value prescribed in the handwriting method of JIS K 5400.

7. The method of producing a scratch print product according to claim 1, wherein said transferable scratch layer further comprises a first peeling layer and has a multilayer structure in which at least said first peeling layer and said hiding layer are disposed in this order from the side close to said substrate film.

8. The method of producing a scratch print product according to claim 1, wherein said pattern layer is provided with patterns comprising a firm name, a logo or a specific mark.

9. The method of producing a scratch print product according to claim 1, wherein said pattern layer contains at least one binder selected from a wax and a thermoplastic resin and/or a coloring agent.

10. The method of producing a scratch print product according to claim 1, wherein said transferable scratch layer further comprises a second peeling layer and has a multilayer structure in which at least said pattern layer, said second peeling layer and said hiding layer are disposed in this order from the side close to said substrate film.

11. The method of producing a scratch print product according to claim 1, wherein said transferable scratch layer further comprises an adhesive layer and has a multilayer structure in which at least said hiding layer and said adhesive layer are disposed in this order from the side close to said substrate film.

12. The method of producing a scratch print product according to claim 11, wherein said adhesive layer is primarily constituted of a rubber type resin.

13. The method of producing a scratch print product according to claim 12, wherein said rubber type resin is at least one type selected from the group consisting of an ethylene/vinylacetate copolymer resin, its modified product and a copolymer of an ethylene monomer, a vinyl acetate monomer and other monomers.

14. The method of producing a scratch print product according to claim 1, wherein said main protective layer is primarily constituted of at least a wax or a thermoplastic resin.

15. The method of producing a scratch print product according to claim 1, wherein said transferable protective layer further comprises an adhesive layer and has a multilayer structure in which at least said main protective layer and said adhesive layer are disposed in this order from the side close to said substrate film.

16. The method of producing a scratch print product according to claim 1, wherein said transferable protective layer further comprises a peeling layer and has a multilayer structure in which at least said peeling layer and said main protective layer are disposed in this order from the side close to said substrate film.

17. The method of producing a scratch print product according to claim 1, the method further comprising; providing an information recording thermal transfer sheet provided with a coloring agent transfer layer on one surface of the substrate film; preparing said transfer-receiving material on which information is recorded in advance by overlapping the coloring agent transfer layer of the information recording thermal transfer sheet on the print surface of the transfer-receiving material on which no information is recorded such that the coloring agent transfer layer faces the print surface and by transferring the coloring agent to the print surface by heating to record the information; and thereafter transferring the transferable protective layer and the transferable scratch layer of said scratch layer transfer sheet to the print surface.

18. The method of producing a scratch print product according to claim 17, the method further comprising: providing a scratch layer transfer sheet in which said coloring agent transfer layer, said transferable protective layer and said transferable scratch layer are alternately provided side by side on one surface of the substrate film; and thermally transferring the coloring agent and the transferable scratch layer to the print surface of said transfer-receiving material from the same scratch layer transfer sheet.

19. The method of producing a scratch print product according to claim 17, wherein said coloring agent transfer layer contains a coloring agent which is optically distinguishable.

20. The method of producing a scratch print product according to claim 17, wherein the color of said coloring agent transfer layer is different from the color of said transferable scratch layer.

21. The method of producing a scratch print product according to claim 17, wherein said coloring agent transfer layer is a heat meltable ink layer.

22. The method of producing a scratch print product according to claim 21, wherein said heat meltable ink layer contains carbon black as a pigment.

23. The method of producing a scratch print product according to claim 17, wherein the area of one partition of said coloring agent transfer layer is different from the area of one partition of said transferable scratch layer.

* * * * *